United States Patent [19]

Aoyagi et al.

[11] Patent Number: 4,528,834

[45] Date of Patent: Jul. 16, 1985

[54] REDUCED ENERGY CONSUMPTION METHOD FOR ROLLING BARS OR WIRE RODS

[75] Inventors: Koshiro Aoyagi; Yukio Noguchi; Koe Nakajima; Matsuo Ataka, all of Fukuoka, Japan

[73] Assignee: Nippon Steel Corporation, Tokyo, Japan

[21] Appl. No.: 600,282

[22] Filed: Apr. 13, 1984

Related U.S. Application Data

[63] Continuation-in-part of Ser. No. 495,457, May 19, 1983, abandoned, which is a continuation of Ser. No. 259,199, Apr. 30, 1981, abandoned, which is a continuation-in-part of Ser. No. 171,236, Jul. 21, 1980, abandoned.

[30] Foreign Application Priority Data

Jul. 23, 1979 [JP] Japan ..... 54-92635

[51] Int. Cl.[3] ..... B21B 1/18; B21B 41/00; B21B 45/02

[52] U.S. Cl. ..... 72/202; 72/228

[58] Field of Search ..... 72/200, 202, 226, 228, 72/231, 234, 364, 365; 148/12 B

[56] References Cited

U.S. PATENT DOCUMENTS

| | | | |
|---|---|---|---|
| 2,658,741 | 11/1953 | Schmidt et al. | 72/200 X |
| 3,486,359 | 12/1969 | Hein | 72/200 |
| 3,625,043 | 12/1971 | Neumann et al. | 72/202 |
| 3,729,972 | 5/1973 | Kocks | 72/202 X |

FOREIGN PATENT DOCUMENTS

| | | | |
|---|---|---|---|
| 85039 | 10/1971 | German Democratic Rep. | 72/202 |

OTHER PUBLICATIONS

Iron & Steel, H. M. Boylston, 2nd Edition, 1936, pp. 360, 361.

The Making, Shaping and Treating of Steel, 1957 Edition, pp. 587, 591, 594.

*Primary Examiner*—E. Michael Combs

*Attorney, Agent, or Firm*—Cushman, Darby & Cushman

[57] ABSTRACT

Bars and wire rods are rolled from billets or blooms in the disclosed process which includes a primary rolling step resulting in an intermediate material, a secondary rolling step and a heat treatment. The primary (first) rolling step includes rolling the billet or bloom steel material into an intermediate material at a mass flow rate to enable it to be maintained during the primary rolling within a temperature range corresponding to a predetermined deformation resistance level of the steel material. This predetermined deformation resistance level is selected so as to take advantage of an opportunity to save energy. The intermediate material resulting from primary rolling is coiled and its temperature is adjusted so as to maintain the intermediate material at a desired starting temperature for the secondary rolling step. The desired starting temperature for secondary rolling is related to a desired starting temperature for the heat treatment following the secondary rolling enabling heat treatment to be carried out in line.

10 Claims, 28 Drawing Figures

FIG.2 (a)
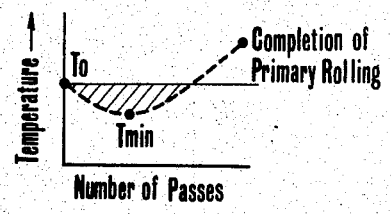
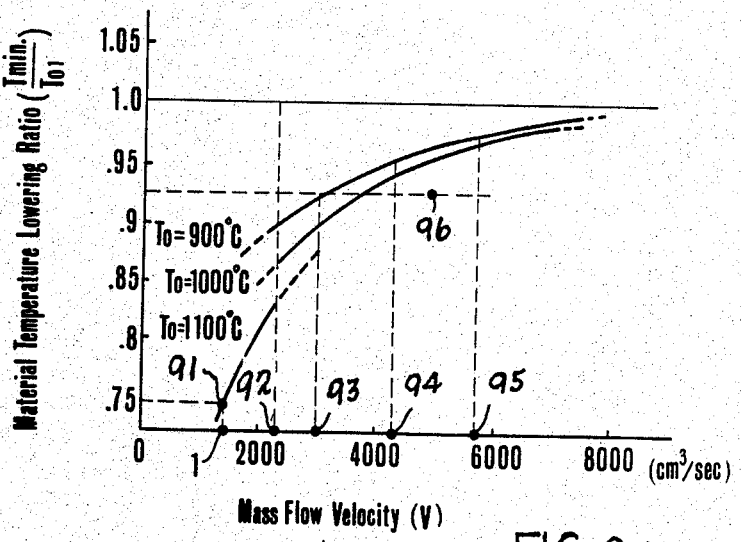
FIG. 2 (b)
FIG.3
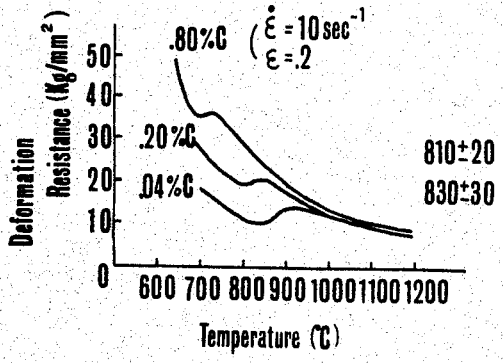

MEAN $\overline{T_i}$ $\overline{T_{i+1}}$

① $\overline{\Delta T_{i+1}}$ ② $\overline{\Delta T_{i1}}$ ③ $\overline{\Delta T_{ci}}$

④ TEMP. LOWERING DUE TO WATER COOLING OF ROLL

⑤ TEMP. LOWERING DUE TO RADIATION & CONVECTION $$T_n' = T_{n-1} + \frac{a}{a+b}(T_n - T_{n-1})$$

REDUCED ENERGY CONSUMPTION METHOD FOR ROLLING BARS OR WIRE RODS

RELATED APPLICATIONS

This application is a continuation-in-part (CIP) of U.S. application Ser. No. 495,457, filed May 19, 1983, abandoned, which was filed as a File Wrapper continuation (FWC) of U.S. application Ser. No. 259,199 filed Apr. 30, 1981, abandoned which was a continuation-in-part of U.S. application Ser. No. 171,236 filed July 21, 1980, abandoned.

BACKGROUND OF THE INVENTION

The present invention relates to a method for producing steel bars or wire rods from steel materials having a square or round cross section with a high productivity and using a smaller consumption of energy with respect to heating and power required for plastic deformation than is required in the carrying out of known methods for producing similar finished product. The process disclosed and claimed herein also satisfies gauge and quality requirements.

According to a known procedure for producing steel bars or wire rods, molten steel is continuously cast into blooms, which are subjected to break-down rolling into billets, and the billets are sent to a bar mill or wire rod mill here the billets are followed by 10 to 30 continuous hot rolling mill stands into bars or wire rods of desired diameters or gage.

According to another known procedure for producing steel bars or wire rods, blooms are sent directly to the bar mill or wire rod mill where the blooms are rolled by 10 to 30 continuous hot rolling mill stands into the desired gages. Some detailed descriptions of the known art will now be made.

FIG. 1 illustrates a conventional bar or wire rod rolling process using a four-strand mill, the steel extracted from the heating furnace 1 is transferred to the rough rolling mill train 2. The material is elongated by alternate reducing forces exerted in both the vertical and horizontal directions by roll grooves such as, for example, of diamond cross section, and square cross section. When a diamond groove is used first, it is necessary to turn the material 90° at the inlet of the square groove. For this purpose twist guides are provided at predetermined positions to twist the material being rolled.

Thus, according to the conventional procedure, a multi-strand rolling using 2 to 4 rough rolling mill trains composed of a plurality of horizontal roll mill stands is performed using the twisting operation described above.

Similar twisting/rolling is also done in the intermediate rolling mill train 3, and only in the finish roll mill train the single strand rolling (without twisting) is performed using a "block-mill" 4. A block-mill is a rolling mill train in which horizontal rolls and vertical rolls are alternately arranged, or a rolling mill train in which the roll axis is inclined ±45° with respect to the vertical axis, then the material is subjected to controlled cooling in the controlled cooling section 5, 6 and finally coiled on the coiler 7.

In the multi-strand rolling system as described above, it is essential to completely interrelate the delivery speeds of the material between preceding stands and subsequent stands all though the rough rolling, intermediate rolling and finishing mill stands. Then, it is essential that the amount of material delivered by one train of the No. 1 stand of the rough rolling mill train be in accordance with that delivered from one train of the final stand of the finishing rolling train. Otherwise the material so processed would suffer defects such as, for example, burrs and breakings between the stands, thus preventing the rolling operation entirely.

Therefore, the cross sectional dimension of the material at the inlet of the rough rolling mill train is inevitably determined by that of the final product at the finishing stand and the rolling speed at the outlet thereof. For example, when a steel wire of 5.5 mm diameter is to be produced using an ordinary block mill having a maximum finishing speed of 60 M/S, the cross sectional dimension of the starting material is limited to 120 mm square maximum from the aspect of the roll life and the lowest material temperature during the rolling process ($Ar_3$ point) to be assured.

Thus, according to the conventional process described above, in which the steel material is reduced in its cross section by a rolling mill train equipped with 10 to 30 or more mill stands, the elongation of the material between the starting material and the final product is normally a factor of 500 to 600 times. Therefore, the ratio of the rolling speed at the initial rolling stand to that at the final rolling stand is 1 to 500–600.

In popular wire rod rolling mills, the rolling speed at the final rolling mill cannot be increased beyond about 60 m/sec. and the rolling speed at the initial rolling stand in proportion to this rolling speed is surprisingly as low as 0.1 m/sec.

Therefore, the temperature of the material at the initial portion of the rolling mill train drops rapidly to a temperature so low that the plastic deformation is no longer possible. For compensating this temperature lowering, the steel material must be heated to temperatures high enough to compensate for this expected temperature drop.

However, the steel material cannot be heated to a temperature beyond the melting point, so that compensation for the expected temperature drop, which would require heating of the material to a temperature beyond its melting point, is practically impossible.

For all these reasons, the conventional procedure has an inherent limitation with respect to the elongation rate, as compared between the starting material and the final product, which is applicable in the rolling mill train. Even in the existing highest-level wire rod rolling mill train, the largest applicable cross section of the starting material is 120 mm to 150 mm square.

Therefore, in the conventional process, a starting material of small cross sectional dimension is used so as to decrease the difference in the rolling speed between the initial portion and the finishing portion of the rolling mill train, thereby alleviating the necessity of lowering the rolling speed required by the lowering of the temperature of the steel material at the initial portion of the rolling mill train.

However, there is a problem with this approach of using a small cross sectional diameter starting material. The blooms and billets which are starting materials for production of bars and wire rods have, in the past, been obtained by breaking down ingots, but this conventional art has been increasingly replaced by the continuous casting of molten steel directly into blooms and billets.

For example, if the bloom is prepared by the continuous casting process, there is a requirement that the cross sectional dimension of the bloom thus obtained should be as large as possible in order to maximize productivity. Also in cases where high-quality wire rods are to be produced from continuously cast blooms, such high-quality blooms can be obtained only when blooms of large cross sectional dimension are continuously cast.

Further, when the blooms prepared by continuous casting have surface defects, these surface defects must be removed by grinding. If the surface area to be removed is determined by a predetermined proportion to the total bloom surface, the surface area to be removed per unit weight of the bloom becomes smaller as the cross sectional dimension of the continuously cast blooms increases. This is because the surface area per unit weight of the material increases as the cross sectional dimension of the bloom decreases.

As explained above, when blooms prepared by continuous casting of molten steel are used as the starting material for the production of bars or wire rods, the desired productivity of the continuous casting process or the desired efficiency of the surface defect removal cannot be achieved without increasing the cross sectional dimension of the starting material.

The advantage of blooms of large cross sectional dimension for obtaining a high productivity and an efficient removal of the surface defects can be achieved also in the process for obtaining blooms by breaking down steel ingots.

SUMMARY OF THE INVENTION

Therefore, one of the objects of the present invention is to provide a process for producing bars or wire rods from a bloom of large cross sectional dimension used as the starting material.

Another object of the present invention is to provide a process for producing bars and wire rods with desirable material properties from a bloom which process requires less energy consumption than conventional processes by controlling the steel temperature during the rolling process.

The above objects of the present invention can be better achieved by the process summarized below.

According to the present invention a process for rolling bars and wire rods of a desired cross sectional dimension and quality from billets or blooms of large square or round cross section is described which includes the successive steps of (a) rolling the billet or bloom in a primary rolling step at a first rolling speed and selecting a mass flow velocity to minimize the total energy consumed in the primary rolling while maintaining the material at about its plastic deformation temperature to produce an intermediate gauge material; (b) storing the intermediate gauge material and controlling the temperature of same between the preceeding step and the succeeding step; (c) rolling the intermediate gauge material in a secondary rolling step at a second rolling speed and at a rate such that the temperature of the material increases during the secondary rolling and producing a material of final gauge and (d) heat treating the material from the secondary rolling step in line.

These steps are conducted under conditions such that (1) the speed of the primary rolling is independent of the speed of the secondary rolling, (2) the temperature of the material at the starting point of the primary rolling step is independent of the temperature of the intermediate material of the start of the secondary rolling step, and (3) the temperature of the intermediate product is controlled such that the temperature at the start of the secondary rolling step is established to deliver a product at the end of the secondary rolling step in accordance with the rolling conditions in the secondary rolling step and in-line heat treatment step that falls within a predetermined range for the subsequent heat treatment step.

In one embodiment of the invention the intermediate material between the primary rolling step and secondary rolling step is coiled. In an alternative embodiment, the intermediate material is not coiled but is accumulated according to unique processing features hereinafter described and illustrated.

BRIEF EXPLANATION OF THE DRAWINGS

FIGS. 2(*a*) and 2(*b*) are graphs showing the relationship between the mass flow velocity (V) of the material being rolled and the ratio of the material temperature lowering to the material initial temperature during primary rolling;

FIG. 3 is a graph showing the relationship between the material temperature and the deformation resistance of the material at various carbon contents;

FIG. 11 is an arrangement for rolling a bar or wire rod material including furnace, rolling stand trains and the like;

DETAILED DESCRIPTION OF THE PREFERRED EMBODIMENTS

General Explanation

Figure 1:
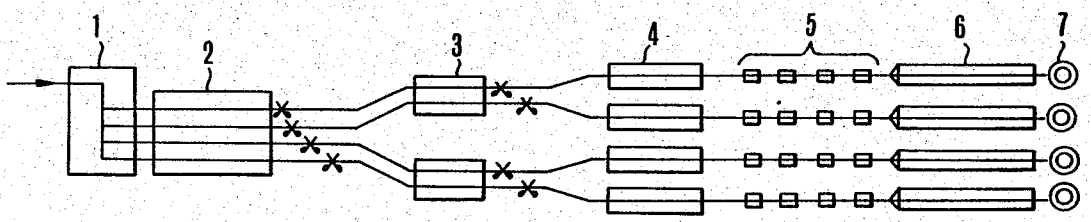
FIG.1 (PRIOR ART)
FIG. 1 (prior art) shows a schematic layout of the conventional rolling mill arrangement.

The present invention will be further described in detail by reference to the attached drawings.

According to one embodiment of the present invention, the rolling mill train for producing bars or wire rods from a bloom or billet is divided into a primary rolling mill train and a secondary rolling mill train, and the starting material is rolled by the primary rolling mill train into an intermediate gauge material, which is then coiled at the end of the primary rolling mill train.

The intermediate gauge material obtained by the primary rolling mill train is supplied from the uncoiler to the secondary rolling mill train, where it is rolled into a final gauge. Thus, according to the present invention, the primary rolling step and the secondary rolling step are separately performed by different rolling mill trains, so that it is possible to reduce the difference in the rolling speed between the initial rolling mill stand and the final rolling mill stand in each of the rolling mill trains.

Therefore, the present invention has an advantage that the rolling from the starting material to the intermediate gauge material can be performed at a rolling speed level much higher than that of the conventional art.

Meanwhile, regarding the secondary rolling mill train for performing the secondary rolling step from the intermediate gauge material to the final gage product, when a sufficient number of trains are provided based on the rolling capacity of the primary rolling mill train, production capacity is balanced between the primary rolling mill step and the secondary rolling mill step, thus enhancing the production efficiency of the mill as a whole. This means not only an increased productivity in the primary rolling step from the starting material to the intermediate gauge material, but also an expanded range of the mass flow of the material applicable in the rolling.

By the arrangement of the rolling mill train which is divided into the primary rolling step and the secondary rolling step as above, the necessity of producing the elongation of the material 500–600 times as compared between the starting material and the final product in one rolling step, as required in the conventional art has been eliminated. Thus, in the present invention, it is very easy to obtain a very fine gauge final product such as, for example, of 2 to 3 mm diameter, in the secondary rolling step from a starting material of a large cross sectional dimension, such as, for example, about 200 mm square.

The present invention has a further advantage that the primary rolling step can be performed with much less energy consumption including heating energy and driving energy than required for conventional processes by utilizing the structural feature that the rolling process is divided into a primary rolling step and the secondary rolling step so that each rolling step can be separately performed at a selected rolling speed.

As shown in FIGS. 2(*a*) and 2(*b*), the temperature lowering ($T_{min}/T_{o1}$:Tminf) represents the lowest temperature of the material in the primary rolling step of $T_{o1}$ represents the starting temperature of the primary rolling of the material being rolled in the primary rolling mill train is largely influenced by the mass flow level of the material. For example, at the conventional mass flow level 1, the temperature of the material lowers from 1100° C. to about 850° C. ($T_{min}/T_{o1}=0.75$) when the starting temperature of the primary rolling is 1100° C.

As shown in FIG. 2(*b*) including data points 91–96, the temperature lowering is remarkable even in a high speed wire rod mill with a capacity of 100 m/sec. for 5.5 mm diameter wire (see point 92 in FIG. 2(*b*)). However, if the mass flow level increases to an adequate level (for example, data point 93 in FIG. 2(*b*)) or higher, the temperature lowering of the material is gradually reduced, and the primary rolling can be performed while maintaining the material temperature in a certain predetermined temperature range, as shown.

Therefore, as the temperature (heating temperature) of the starting material can be lowered, the energy required by the heating can be markedly saved.

The appropriate level of mass flow is determined by the relation between the heating energy and the deformation resistance zone of the material which minimizes the total energy required by the heating and the plastic forming, and it is desirable to maintain a mass flow level corresponding to or higher than about 0.90–0.95 ($T_{min}/T_{o1}$) of the material temperature lowering ratio.

On the other hand, as shown in FIG. 3, there is a correlation peculiar to a specific steel grade between the material temperature and the deformation resistance of the material in a rolling process such as for rolling of steel bars and wire rods.

Figure 4:
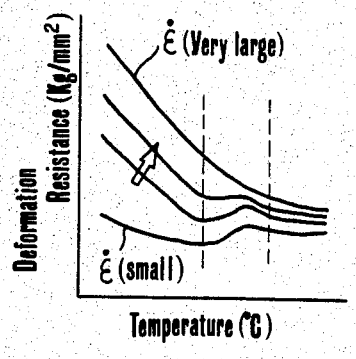
FIG. 4 is a graph showing the effects of the strain rate on the deformation resistance of the material near the transformation point of the material.

For example, in the case of a steel material containing about 0.04% carbon, the steel material shows less deformation resistance at about 830° C. than that at 900° C. This tendency, as shown in FIG. 4, is influenced also by the strain rate. This tendency, however, disappears at an extremely high strain rate. On the other hand, in the case of a steel material which shows an allotropic transformation at a low strain rate, the above tendency clearly appears up to a strain rate of about 100 sec.$^{-1}$.

By combining the feature that the primary rolling step can be carried out within a predetermined temperature range in which the deformation resistance of the material lowers, the primary rolling step can be performed with less rolling energy.

Further, as the primary rolling is carried out in a lower deformation resistance range, the rolling mill can be made compact.

Also, as often observed in rolling of stainless steels, the groove-filling degree (width expansion) of the material being rolled changes depending on the material. Therefore, according to the present invention, as the rolling can be performed within a predetermined temperature range, it is possible to maintain an appropriate groove-filling degree throughout the rolling process and hence damages of the rolling mill by the material being rolled can be avoided.

As described above, as the primary rolling step can be done at a lower heating temperature and with a small rolling energy, the total energy consumption of the entire process can be greatly reduced with respect to the energy required by conventional processes.

The intermediate gauge material obtained by the primary rolling step is then stored by being coiled or otherwise accumulated. The thus stored material is thereafter transferred to where the secondary rolling step is carried out, during which it is rolled to the final gauge desired.

According to the present invention, in the secondary rolling step, the temperature of the material at the completion of the secondary rolling step is controlled to be within the temperature range, specified for starting the heat treatment following the secondary rolling step.

For this purpose, determination is first made as to what heat treatment should be done after the completion of the secondary rolling step on the basis of the final gauge of the wire rod and the material quality to be obtained.

When the heat treatment conditions are determined, the temperature range of the material allowable at the time of starting the heat treatment, namely after the completion of the secondary rolling step, is determined. Then, the temperature of the material at the starting point of the secondary rolling step is determined on the basis of the rolling conditions of the secondary rolling step, such as the number of passes and the cooling condition, so as to assure that the material temperature will fall within the allowable temperature range desired at the end of secondary rolling.

In order that the intermediate gauge material obtained by the primary rolling be maintained at a predetermined temperature level at the starting time of secondary rolling, the intermediate material is heated or cooled by adjusting the in-line cooling condition on a cooling trough immediately after the completion of primary rolling and adjusting the temperature maintaining condition of the material during its storage.

Thus according to the present invention, the process of rolling bars and wire rods is divided into a primary rolling step and a secondary rolling step, each step being independent of the other, and in each of the rolling steps, the rolling speed and the temperature of the material at the starting point of the rolling can be independently selected. Further between the primary rolling step and the secondary rolling step, the temperature of the intermediate gauge material is adjusted so as to assure that the material temperature at the starting point of the secondary rolling step is such that the material temperature at the completion of the secondary rolling step will be within a predetermined temperature range.

According to the present invention, the primary rolling is performed by selecting such a mass flow velocity as can minimize the total energy consumption required for heating and rolling, and in the secondary rolling step, the material temperature at the starting point of the secondary rolling step is determined by a computer taking the rolling condition into consideration so as to assure that the material temperature after the secondary rolling step will be appropriate for the in-line heat treatment. The material temperature is adjusted between the primary rolling step and the secondary rolling step so as to agree with the predetermined material temperature at the starting point of the secondary rolling step. Therefore, energy consumption can be markedly saved, and at the same time the gauge and quality requirements of the finished product can be satisfied.

The present invention will now be described, in part, with reference to FIGS. 5(A), 5(B) and FIG. 6.

Figure 5A:
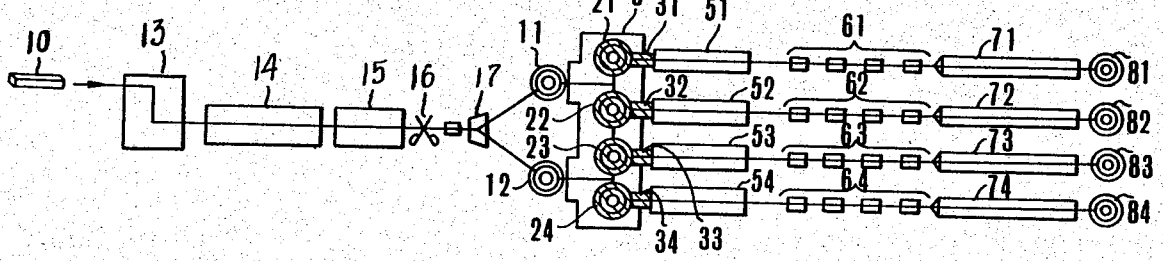
FIGS. 5(A) and (B) show respectively a rolling mill arrangement of an embodiment of the present invention.

In FIG. 5(A) showing one embodiment of the present invention, a hot or cold material 10 is heated to a predetermined temperature in a heating furnace 13, and then rolled by a rough rolling mill 14 and an intermediate rolling mill 15.

In this case, it is preferably from the aspect of product quality that the rough rolling mill 14 and the intermediate rolling mill 15 are respectively a mill of the type equipped with horizontal rolls and vertical rolls arranged alternatively, and the material is rolled by these mills in a non-twisting way. Needless to say, the rolling may also be performed by a H-H type mill (twisting type).

The material desirably has a weight large enough to obtain one or more of coil of a predetermined weight, and for this purpose the material is cut into a desired length by a shear 16 and alternately distributed to coilers 11 and 12. The alternative distribution is performed by a distributor 17.

In this case, the coilers are matched with the secondary rolling step in such a manner that the coiler 11 completes coiling of the first piece of the material cut by shears and becomes full, while the coiler 12 is coiling the second piece of the material, so that the third piece of the material cut by the shears is distributed to the coiler 11, and while the third piece is being coiled on the coiler 11, the fourth piece of the material is distributed to the coiler 12. The above distribution procedure is repeated. If necessary, the finishing end of the last piece of the material is cut.

The coiled materials (hereinafter called coils) above obtained are transferred on a conveyor to a heat-retaining furnace 8 and are set on uncoilers 21 to 24.

In this case, the coils are coiled with the starting end for the rolling being positioned on the lower side and the finishing end being positioned on the upper side, but it is preferably that the secondary rolling step begins with the finishing end positioned on the upper side. Thus, th coiling operation is done in such a manner that the finishing end portion of the material projects linearly about 100 mm at the time of the coiling operation and the coiling speed etc. is controlled immediately before the completion of coiling. In this way, the finishing end is automatically caught and delivered into pinch rolls 31 to 34, which function as a pretreatment device. Hence the material handling from the primary rolling step to the secondary rolling step can be performed with great economy.

The pinch rolls (pretreatment devices) 31 to 34 function a a pinch roll and a correction roll as well as a mechanical descaler and the starting end portion of the material are subjected to straightening and descaling by the pinch rolls and are fed to finishing rolling mill stands 51 to 54. After the finishing rolling, the rolled materials are subjected to a prescribed in-line heat treatment 61 to 64 and 71 to 74, so as to obtain desired qualities or surface conditions and are coiled on a final coiler 81 to 84.

Figure 5B:
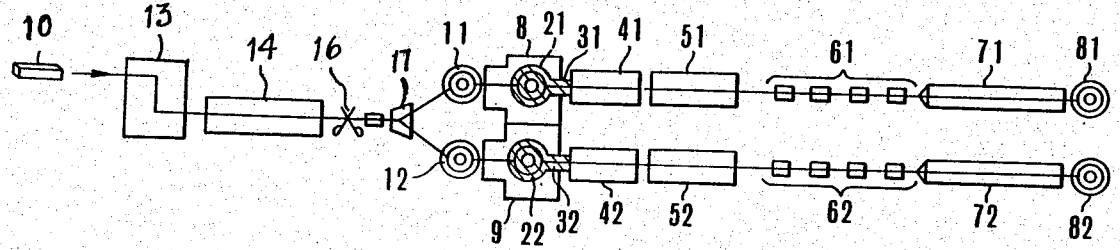

FIG. 5(B) shows another embodiment in which the intermediate rolling mill stands 41 and 42 are arranged on the side of the secondary rolling step. Two or more trains of the intermediate rolling mill stands are required, hence this arrangement is less advantageous than the embodiment shown in FIG. 5(A) with respect to the capital investment, but this layout is more suitable for production of final products which must satisfy severe requirement of the surface condition, particularly with respect to the surface scale etc., because the cross sectional dimension of the material during the intermediate coiling step can be made larger than in the layout shown in FIG. 5(A).

It should be understood the rolling mill train in the secondary rolling step is not limited to those shown in FIGS. 5(A) and 5(B), and other types of mills such as a multi-strand mill may be used.

The temperature of the intermediate coiling is determined so as to avoid lowering of yield due to scale formation or quality degradation caused by decaburization etc., taking into consideration factors such as the resistance of the material to the coiling. The temperature is maintained within a range of from about 600° C. to 900° both for the systems shown in FIGS. 5(A) and 5(B) by means of a forced cooling step in the primary rolling step, if necessary. This temperature range is maintained until the material is delivered to the secondary rolling step.

The desired temperature of the material before the secondary rolling step is determined by computing the heat energy generated by the working of the material. This is determined by the total elongation ratio of the material, the number of passes, and the rolling speed and computing the heat energy which must be removed from the material during the secondary rolling step. This allows the material temperature after the secondary rolling step to coincide with a desired starting temperature of the subsequent heat treatment.

The secondary rolling is normally done with a rolling speed of 30 to 60 m/sec. or higher for a final product of 5.5 mm diameter, thereby it is possible to maintain the finishing temperature, for example 1000° C. to 1100° C., necessary for metallurgical control of the material in controlled cooling steps 61 to 64 and 71 to 74 after the completion of the secondary rolling step.

Thus, as the rolling speed increases, heat generation caused by the working becomes larger than the heat discharge from the material and the material temperature rises.

When a material which requires a lower level of material temperature at the final finishing rolling of the secondary rolling step is to be rolled, the secondary rolling mill train can be divided into two blocks, and a cooling means such as a cooling trough, is provided between the two blocks so as to attain the predetermined final rolling temperature in spite of the temperature rise due to the heat generation in the secondary rolling step.

In order to maintain the desired material quality at each step of the intermediate cooling, heat retaining the uncoiling, it may be possible to apply a scale-preventing agent such as glass powder on the surface of the material being rolled in the temperature range of from 850° C. to 1000° C. Also one may use a radiant tube-type heat retaining furnace to provide an oxidation-reventing atmosphere or use a reducing atmosphere using $N_2$ gas or the like in the heat retaining furnace, or use a combination of these measures in addition to the relatively lower temperature hot coiling and the heat retaining as mentioned above. Further, if necessary, an induction heater may be provided at the outlet of the heat retaining furnace so as to effect auxiliary heating before the secondary rolling step.

The auxiliary heating by the induction heater is particularly effective for heating the surface portion of the material which is readily otherwise cooled.

Figure 6:
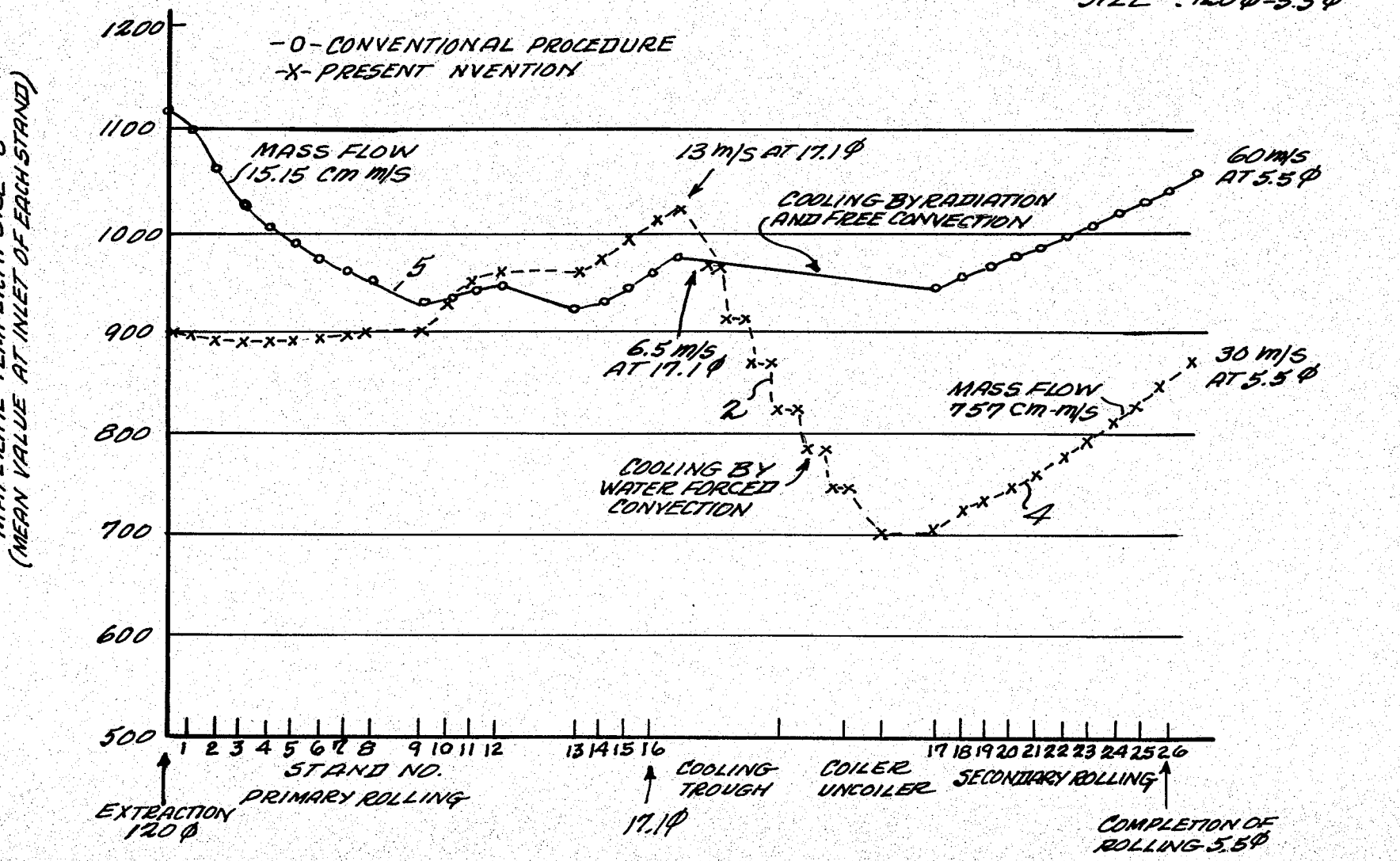
FIG. 6 is a graph showing the temperature changes of the material being rolled in the present invention, illustrated by the dashed line, as compared with those in the conventional procedure as illustrated by the solid line.

The typical temperature history curve of the material from the extraction of billet from the heating furnace in the system of FIG. 5(A) is shown in FIG. 6, in which circular solid data points represent the process of the present invention and the circular open data points represent a conventional process. Curve portion 1 represents the temperature history from extraction from the heating furnace to the completion of the primary rolling step, curve portion 2 represents the temperatures at the forced cooling after completion of the primary following step and the temperature lowering during the coiling and the transfer, curve portion 3 represents the temperature during the heat retaining step and the uncoiling step prior to the secondary rolling step, and curve portion 4 denotes the temperature history in the secondary rolling step in which the temperature rises because the heat generating due to the working is larger than the heat discharge from the material.

Curve 5, having the circular open data points represents a typical temperature history curve for the conventional rolling system, from which it is clearly shown that the lowering of the material temperature is substantial from the billet extraction from the furnace through the rough rolling step and the intermediate rolling step.

From the aspect of the material heat treatment, the process of the present invention can also markedly lower the extraction temperature from the furnace, as compared with the conventional procedure, for obtaining the same final finishing temperature and hence considerable energy savings can be achieved.

Figure 7:
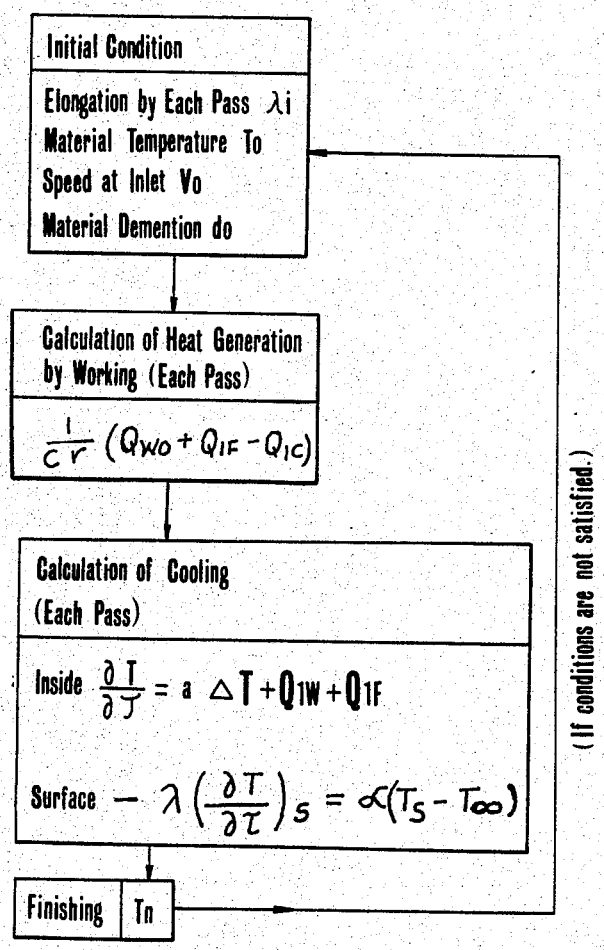
FIG. 7 shows a procedure for determining the rolling conditions in the secondary rolling step.

FIG. 7 is a flow chart explaining how to determine the rolling conditions (initial conditions), desirable at the beginning of the secondary rolling step such as the starting temperature $To_1$ of the secondary rolling step, the dimension $d_o$ of the material at the inlet of the secondary rolling step, namely the coil after the primary rolling step for obtaining a desired wire diameter dm at a desired finishing temperature Tn at the end of secondary rolling. Knowing the desired finishing temperature Tn (corresponding to a desired heat treatment temperature (after secondary rolling)) one assumes certain initial rolling conditions and calculates in accordance with the FIG. 7 flow chart. If the desired finishing temperature Tn is not achieved, then the initial rolling conditions assumed are changed and the calculation is again carried out. This procedure is repeated until the desired finish temperature Tn is achieved.

For computation of the amount of temperature rises T due to the heat generation by the working in the secondary rolling step, the cross sectional diameter $d_o$ of the material, the velocity $V_o$ of the material at the inlet of the secondary rolling step, the temperature $To_1$ of the material, and the elongations $\lambda 1, \lambda 2 \ldots \lambda i \ldots \lambda n$ of the material at each pass of the secondary rolling step are given to a computer.

Further, the heat discharge of the material during the rolling step or the temperature drop due to the heat discharge of the material during the rolling or due to the cooling is calculated so as to obtain the final finishing temperature Tn.

If the temperature Tn (based on the assumed initial conditions) is found to agree with the starting temperature of the heat treatment (to be carried out after secondary rolling) required for producing a desired rolled product, then the rolling operation is performed under these conditions. If the temperature Tn is not in accord with the starting temperature, the computation is again performed after changing the assumed initial conditions, such as the secondary rolling speed. In this way, the conditions which satisfy the temperature Tn are determined and the rolling is performed accordingly.

Using the above method it is possible to set the material temperature level in the heat retaining step for the secondary rolling to a condition which assures high-quality products with greatest economy.

In FIG. 7, the various elements of the equations are defined as follows:

For The Calculation Of Heat Generation By Working (Each Pass)

$\Delta T$: Average temperature change of the material in plastic working $Q_{1W}$: Working heat $Q_{1F}$: Quantity of heat flown in the material out of the friction heat between the roll and the material $Q_{1C}$: Quantity of heat flowing out of the material due to the contact thermal conduction between the roll and the material c: Specific heat of the material $\gamma$: Specific weight of the material For the Calculation of Cooling (Each Pass) Inside T: Temperature of the material $\tau$: Time $\alpha$: Thermal diffusivity $\Delta$: Laplacian operator in one dimension, i.e., $$\Delta = \frac{\partial^2}{\partial \gamma^2} + \frac{1}{\gamma} \frac{\partial}{\partial \gamma}$$

where $\gamma$: The cylindrical coordinate (radial coordinate)

For The Calculation Of Cooling (Each Pass) Surface $\gamma$: Thermal conductivity $\alpha$: Heat transfer coefficient for fluid S: Surface $\infty$: Free stream Hereinbelow, description will be made on the process carried out between the primary rolling step and the secondary rolling step.

Figure 8A:
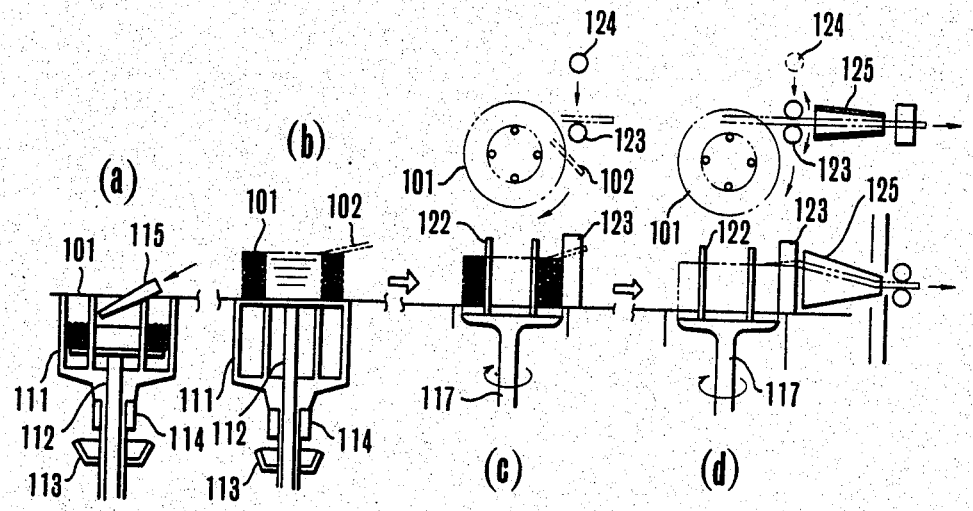
FIGS. 8(A) and (B) show schematically the apparatus for handling the material after the primary rolling step until the material is supplied to the secondary rolling mill train.
Figure 8B:
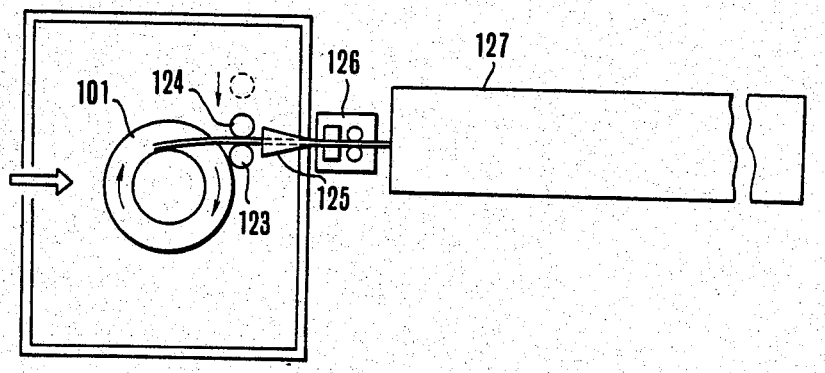

FIG. 8A (*a*) shows schematically a coiler for pouring reels, 111 is a reel which is rotated through a bevel gear 113, 114 is a bearing, 112 is a lifting device for lifting the coil 101. The wire rod enters through a chuter 115.

FIG. 8A (*b*) shows the finishing step of the coiling, 101 represents the coil and 102 represents the tail end of the wire rod. The material speed is controlled relative to the coiling speed so as to cause the tail end to project in the tangential direction slightly deviating from the circumference of the coil at the completion of the coiling. Then the coil is transferred by a pusher etc. to an uncoiler 122 set in the heat retaining atmosphere as shown in FIG. 8A (*c*). The uncoiler 122 rotates in a direction reverse to that for the coiling slowly in the initial stage, and when the tail end 102 of the coil contacts the pinch roll 123 rotates at a constant speed. The uncoiler is stopped temporarily, so as to cause the pinch roll 124 to approach the pinch roll 123 to bite the tail 102 therebetween. The pinch rolls 123 and 124 are rotated at the same peripheral speed as soon as the coil material held between the pinch rolls 123 and 124 starts to be fed, the uncoiler 122 is rotated again. It is desirable that the biting force between the rolls 123 and 124 is such as to slightly hold the material without deforming the material.

In this way, the material advances now with the tail end of the coil to the front, just contrary to the primary rolling step, through a trumpet-shaped guide 125 arranged next to the pinch roll 123 to enter the pretreatment device 126 of the secondary rolling step for straightening and descaling the material, arranged outside the heat retaining atmosphere.

The pretreatment device 126 may be mainly of a mechanical structure, for example, equipped with pinch rolls, comprising at least one horizontal and one vertical roll suitably arranged, or of a light reduction structure, and in cases of necessity may use compressed air, steam, high-pressure water and the like in combination.

With the above pretreatment, the material is completely removed of surface scale, and transferred to the secondary rolling step 127 where the secondary rolling is performed to obtain a final product through the steps mentioned hereinabove.

As the material is retained in the transient step between the primary rolling step and the secondary rolling step, space savings are realized and the entire rolling mill will be simple and compact. Further, connection between individual steps is automatically done and there is no problem with respect to manpower.

Also, when the material is temporarily stored, the material is maintained at a relatively low temperature as mentioned hereinbefore, so that the fuel consumption is only several per cent of that required by an ordinary heating furnace, thus substantial energy savings can be achieved by lowering the heating temperature of the starting material.

Also, according to the present invention, it is basically possible to lower the finishing rolling speed by increasing the number of the secondary rolling mill trains, so that the finishing temperature can be controlled as desired in combination with the controlled cooling for improvement of metallurgical properties.

Another means of storing the material is an accumulator. There are situations in which coiling the bar or wire material may not be preferred. For instance as the length of material and the size of the loop grows during processing the loop length reaches its maximum when the tail end of the material being rolled pulls out of a rolling mill disposed at the first stage. In order to conserve energy the practice has been to increase the weight of materials being rolled which, in turn, increases the loop length due to the increased size of the material. The difference in rolling time between the leading and trailing ends of the material causes a substantial difference in temperature with a detriment to further rolling operations. Thus an accumulation arrangement has certain heat-savings advantages over coiling procedures.

Figure 10:
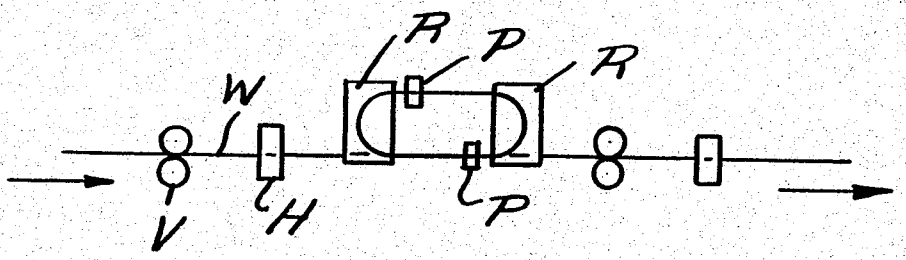
FIG. 10 is a schematic layout illustrating forming a single loop layer accumulator.

In order to better illustrate the technique reference is made to FIG. 10 showing schematically the formation of a single loop. Reference letters V and H denote bar or wire rod rolling stands, W is the wire rod and R repeaters arranged to form a loop between the rolling stands. Repeaters R of identical shape but face each other forcing the wire rod material W to turn 360° into a single loop. P denotes pinch rolls on the incoming side of each repeater to take the wire rod material into a loop.

Figure 11:
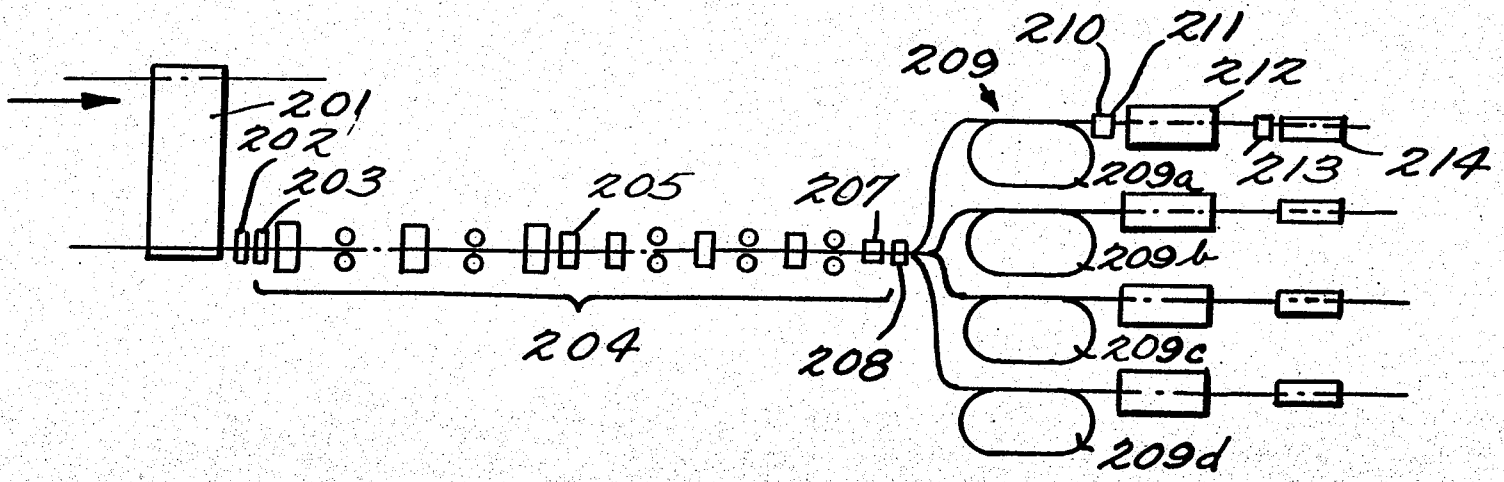

FIG. 11 illustrates schematically and arrangement in which the rod material is accumulated in large quantities. A heating furnace 201 heats the incoming large sectional size cast delivered from a continuous casting procedure. The material is removed from the furnace via pinch rolls 202 and descaled at 203 then subjected to a primary rolling step, as described in more detail above, which in the arrangement depicted consists of an 11 pass rough rolling stand train; flying shears 205 and 207 cut the processed material where required and distributor 208 allocates the material to the various loop accumulators 209.

Each loop accumulator 209 *a–d*, described in more detail below in respect of FIGS. 4–7, temporarily accumulates the roughly rolled material and arrange it into a ring-like winding into several layers in the vertical direction as desired. Flying shears 210 and a descaling device 211 are also shown. In the illustrated embodiment an intermediate rolling stand train or block 212, optional snip shears 213 and finish rolling block 14 are shown; not illustrated are further in-line heat treaters and coilers. By virtue of the discontinuous operation allowed by the use of the accumulators the capacity of the bar or wire rod being processed allows the primary rolling step to be operated at a higher rolling speed.

Figure 13:
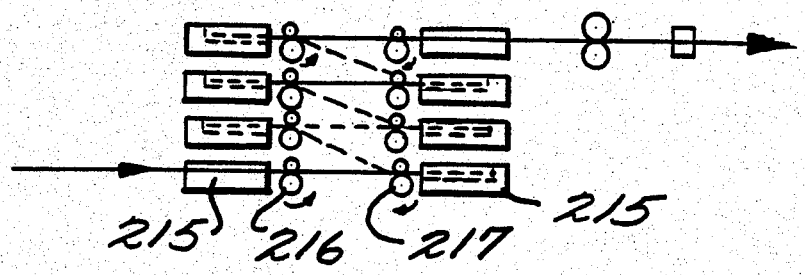
FIG. 13 is a sectional view of an accumulator taken along line A—A of FIG. 12.
Figure 14:
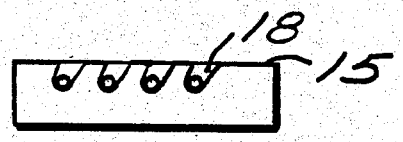
FIG. 14 is a sectional view of an accumulator taken along line B—B of FIG. 12.
Figure 15:
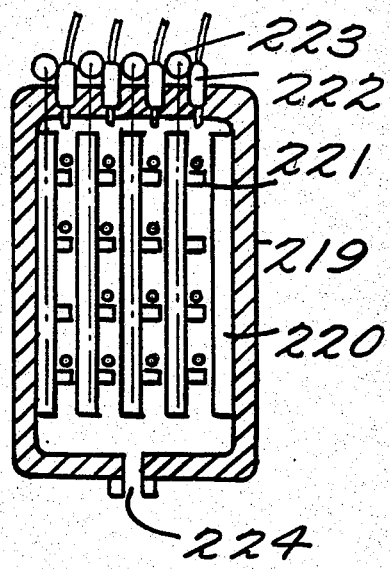
FIG. 15 is a sectional view of a portion of an accumulator taken along line C—C of FIG. 12.

Yet another arrangement that may be used is a series of grooved-type repeaters arranged to guide a wire rod material by turning it around in the usual bar or wire rod material rolling facilities. As shown in FIG. 13 repeaters 215 are arranged confronting each other and arranged in several stages along the vertical direction one on top of another as shown in FIG. 13 illustrating 4 stages. Each pair of opposing repeaters have pinch rolls 216 and 217 on the entrance side. Several grooves are provided in each repeater 215, as shown in FIG. 15, the number being determined by the number of turns the wire rod material is wound round per stage. Preferably a straight passing part which directs the bar or wire rod material to move in a straight direction between opposing repeaters 215 is provided; such a part is illustrated in FIG. 15.

As shown in FIG. 15 a refractory-material cover 219 surrounds the entire part where the bar or wire material passes. Side guides 220 are evenly spaced for dividing the bar or wire rod material. Several base plates 221 as may be required are disposed along the side guides and these may be open or closed as desired. Heating burners 222 are positioned on the top of the cover 219 while cylinders 223 move the base plates as desired. An exhaust port 224 is provided.

The primary or roughly rolled bar or wire rod material has an increased surface area and is wound round by the accumulators 209 and thus causes a temperature drop, thus in some applications it is advisable to have a heat retaining/supplementing device as in FIG. 15.

Figure 12:
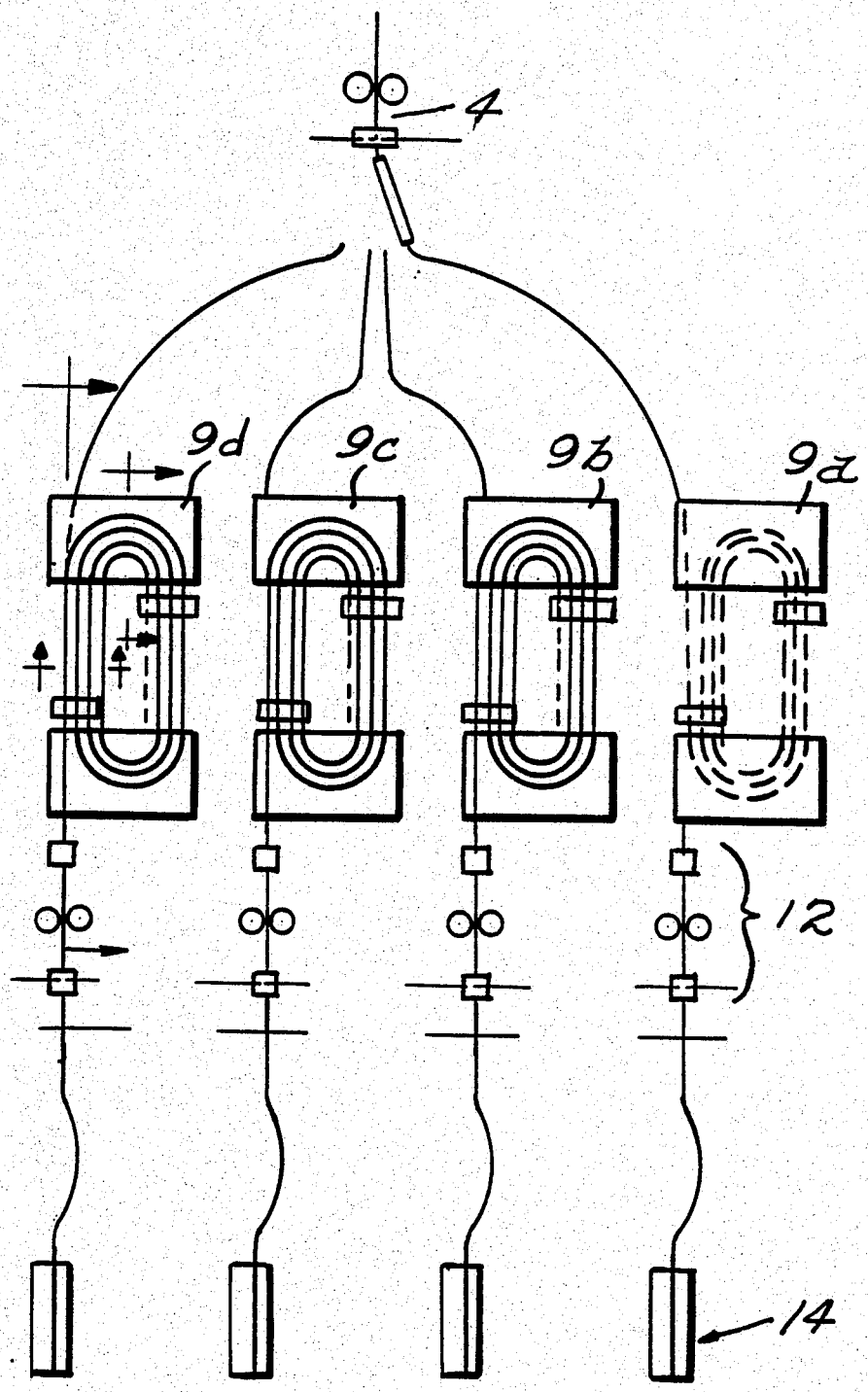
FIG. 12 is an overall plan view of a series of four loop accumulators and their operation.

As illustrated in FIG. 12, in operation, after primary rolling the bar or rod material is directed to an arbitrary loop accumulator 209 by selector 208 an is accumulated into a multiple larger ring. After completion of one loop on a first accumulator, say 209*a*, the selector 208 directs the supply to another loop accumulator, say 209*b*, and the material is there accumulated. The bar or wire rod material is thus accumulated at the four loop accumulators 209*a*–209*d* in series. Heaters (not shown) are optionally included within the accumulators to prevent substantial fall-off of the rolling temperature as may be required.

Figure 16:
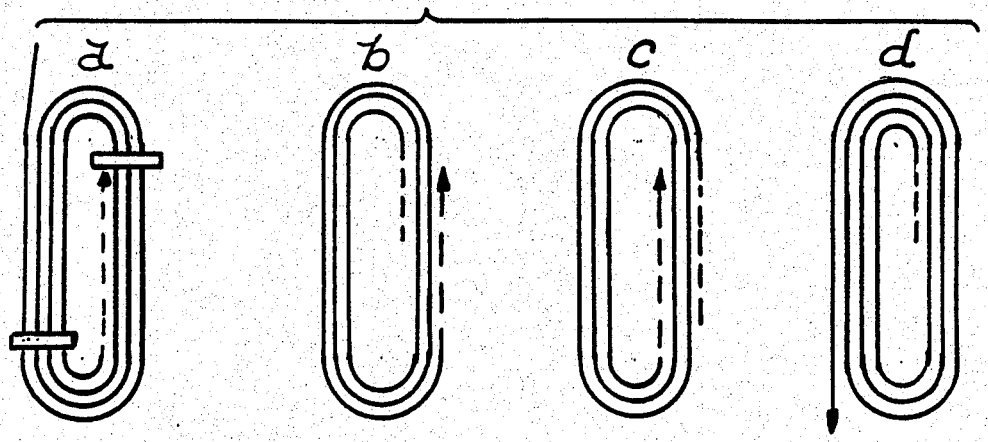
FIGS. 16(*a*)-(*d*) illustrate a bar or wire rod material as it is accumulated.

FIGS. 16(*a*)–(*d*) illustrates in operation the various arrangements of the bar or wire rod material in loop accumulators 209. Assuming with respect to the illustrations that the bar or wire rod material is accumulated starting from the lower portion upward, the bar or wire rod material is initially wound round from the outer side to the inner side of the loop via pinch rolls shown schematically in FIG. 16(*a*). Next the material is wound in the second stage from the inside to the outside as shown in FIG. 16(*b*), and then in the third stage from the outside to the inside as in FIG. 16(*c*) and again from the inside to the outside, which is the uppermost stage, as shown in FIG. 16(*d*). After completing the accumulating process the tip of the bar or wire rod material is guided to the next rolling or treatment step. The length of each loop at each stage remains substantially constant throughout the accumulation process.

The process of introducing and withdrawing the bar or wire rod material is shown in FIG. 12 showing material from the primary rolling step being introduced into accumulator 209(*a*), the preceding length of bar or wire rod material having just been removed from accumulator 209(*a*) for further processing, in this instance twin rolling stand trains 12 and 14. While the bar or wire rod material (shown in the solid line above 209(*a*)) is being introduced pinch rolls 216 and 217 operate at a speed corresponding to the exit speed of the rolling stand train 4. As the entrance speed of the intermediate rolling stand train is slower than the speed of pinch rolls 16 and 17, the distance between the preceding bar or wire rod material and the succeeding bar or wire rod material gradually shortens. Loop accumulators 290(*b*)–(*d*) are also shown discharging accumulated bar or wire rod materials. The bar or wire rod materials accumulated at each accumulator 1 can be taken out of any of the four stages as may be convenient.

It is preferred that in each accumulating loop 209 the sets of pinch rolls 216 and 217 are driven independently of the other loops and accumulators. Using this arrangement the material is processed in accordance with the rolling speed of the subsequent, downstream processing steps. This not only permits precise control over the length of each loop but also allows a minimal interval between successive lengths of bar or wire rod material. The arrangement also allows a higher rolling speed in the primary rolling step wire preventing, to the extent possible, significant loss of heat value from the material being so processed.

It will be understood that the number, location and operation, such as the number of turns per stage, the number of layers or stages in the vertical direction and the like, may be varied in accord with the cross-sectional area and length of material to be rolled, the rolling speed and like factors.

With respect to the various operating conditions, the key point of the invention is that in the primary rolling step a temperature range is selected that minimizes the total sum of the material heating energy and the rolling energy, and the rolling is done within this temperature range. This temperature range is maintained constant through the primary rolling step by maintaining the mass flow velocity of the material at an appropriate value.

The temperature which minimizes the total sum of the material heating energy and the rolling energy necessarily varies depending on the steel composition such as the carbon content, and the strain rate.

However the present invention is operated in a zone where the strain rate has no substantial influence. Therefore only the carbon content may be considered. Therefore, the temperature range is determined only when the steel composition is specified to a constant value. Thus in the present invention, the mass flow velocity is determined in correspondence to the steel composition particularly the carbon content.

The low carbon steel used in the present invention contains not more than 0.12% carbon. With this carbon content range, the minimum deformation resistance is found in the temperature range from 800° to 900° C., as shown in FIG. 3, and when the rolling is done within this temperature range the primary rolling can be done with the minimum total sum of the heating energy and the rolling energy.

The appearance of the minimum point of the deformation resistance varies depending on the steel's carbon content. In the case of high carbon materials containing 0.5% or more carbon, no minimum point appears.

Therefore, in the case of intermediate and high carbon materials containing more than 0.12% carbon, the temperature which minimizes the total sum of the heating energy and the rolling energy is computed from FIG. 3 to determine the material temperature in the primary rolling step.

The mass flow velocity range in the primary rolling step is at least 2000 $cm^3$/second irrespective of the carbon content, and an appropriate velocity is selected on the basis of the material temperature in the primary rolling step. The material temperature between the primary rolling and the secondary rolling is controlled by the intermediate cooling and heat retraining so as to minimize the scale loss during the heat retaining step and maintain a good surface condition. For this purpose the material temperature between the primary and secondary rolling steps is maintained in a range from 600° to 900° C.

EXAMPLES

The present invention will be better understood from the following examples.

The rolling conditions applicable to the secondary rolling step are determined by the procedure shown in the FIG. 7 flow chart.

intermediate coiling with 20 mm diameter using an arrangement of the type shown in FIG. 5(A).

The starting material is a low-carbon steel containing 0.06% carbon, extracted at about 900° C. from the heating furnace, passed through the descaler and so on, subjected to the initial rolling at about 885° C. in average, reduced down to 41 mm square from 240 mm square with only indirect cooling by the roll cooling water, and the material is advanced through the process. The rolling is performed within a very stable temperature range of from 865° C.±15° C. in average. The mass flow speed is about 5700 $cm^3$/sec. and as shown by 5 in FIG. 2, the temperature lowering of the material is very small.

The rolling reduction from 41 mm square to 30 mm diameter is performed with the same mass flow, but the running speed of the material gradually increases so that the heat generation due to the plastic deformation is greater than the heat discharge and the average temperature of the material gradually rises. It is naturally easy to suppress the temperature to 865° C.±15° C. just as in the initial rolling stage by using water cooling in an appropriate matter.

In this way, the primary rolling step is completed. However, in order to assure a desirable starting temperature of the secondary rolling step and to suppress the loss by scaling during the intermediate storing step, the material after the primary rolling step is subjected a suitable in-line cooling (in these examples cooled to 800° C.) such as by a cooling trough (not shown) and is coiled.

Then the coiled material is transferred to the uncoilers arranged in the storing furnace and maintained at about 800° C., then subjected to the secondary rolling step.

In the case of low-carbon steels as used in these examples, it is not necessary to control the temperature during the secondary rolling step as required from the aspect of quality control, and the cooling before and during the rolling may be done under ordinary conditions.

However, as a non-twisting type block mill having a normal capacity of 60 m/sec. (finishing speed for 5.5 mm diameter) is used for the secondary rolling mill, the distance between the individual stands is short and the heat generation due to the working exceeds the heat discharge so that the material temperature markedly

TABLE 1

| Step | | Size (mm dia) | Rolling Speed (m/sec.) | Number of Strand | Low-Carbon Steel Average Temp. (°C.) | Low-Carbon Steel Cooling | Medium-Carbon Steel Average Temp. (°C.) | Medium-Carbon Steel Cooling |
|---|---|---|---|---|---|---|---|---|
| Primary Rolling | Start | 240 (mm square) | 0.10 | 1 | 885 | Weak Cooling only in the last half portion of the step | 980 | No Forced Cooling |
| | Finish | 20 | 18 | 1 | 860 | | 990 | |
| Intermediate Coiling & Storing | | 20 | — | — | 800 | Heat Retaining | 800 | Heat Retaining |
| Secondary Rolling | Start | 20 | 4.5 | 4 | 780 | No Forced Cooling | 780 | Forced Cooling with Thermal Conductivity (α) of 1500 Kcal/$m^2$h °C. |
| | Finish | 5.5 | 60 | 4 | 1100 | | 850 | |

Table 1 shows examples of the present invention in which 5.5 mm diameter wire rods were produced from a starting material of 240 mm×240 mm through an increases and the finishing temperature reaches 1050° C. or higher.

After the secondary rolling step, the rolled material is subjected to in-line cooling by a cooling trough and controlled cooling under a loosely coiled state.

In the case, on the other hand, where a controlled rolling is required in the secondary rolling step, for example, for rolling a medium-carbon steel, no particular advantage can often be obtained even if the primary rolling is done at temperatures around the transformation point of the material, and in such cases, it is often advantageous to commence the rolling at a temperature ranging from 900° C. to 1000° C. in average. Above all it is important to prevent a substantial temperature lowering in the primary rolling step. This can be done by maintaining the mass flow rate in the primary rolling step in the order of 5700 $cm^3$/sec. as specified hereinbefore.

The intermediate coiling temperature is determined on the basis of the material loss due to scaling in the storing stage, the finishing temperature of the secondary rolling step etc.; namely in accordance with the flow sheet shown in FIG. 7.

For example, if the desired finishing rolling temperature of the secondary rolling step is 850° C. in average, the temperature of the material in the storing stage is 800° C.

Figure 9:
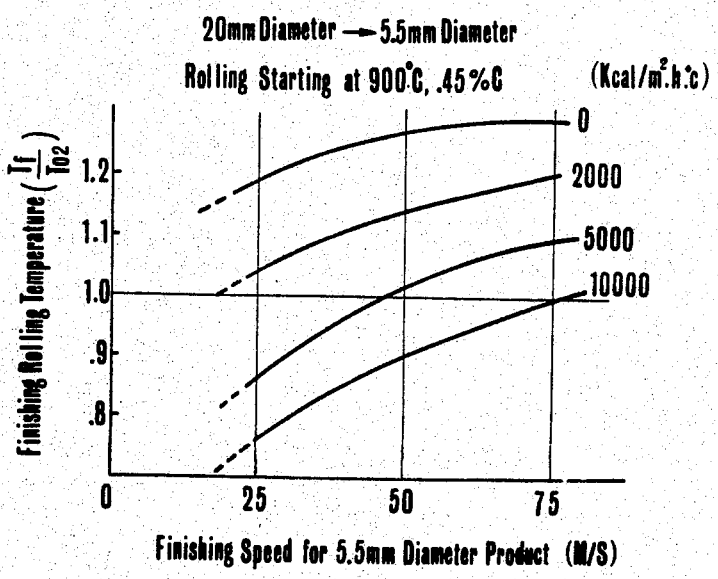
FIG. 9 is a graph showing the relationship between the finishing rolling speed in the secondary rolling step and the ratio of the finishing rolling speed to the starting temperature of the secondary rolling step.

Thus FIG. 9 shows the relation between the finishing speed for a 5.5 mm diameter product, the material temperature lowering ratio ($T_f/R_{o2}$, $T_f$=material temperature immediately after the completion of the secondary rolling step, $T_{o2}$=material temperature at the start of the secondary rolling step) in the secondary rolling of a medium-carbon steel from 20 mm diameter to 5.5 mm diameter using the rolling line FIG. 5(A) as shown. In this case, for obtaining the temperature lowering ratio $T_f/T_{o2}$, the starting temperature of the secondary rolling is maintained constantly at 900° C., and the thermal conductivity is varied by forced cooling in the secondary rolling mill train.

When the finishing speed for the 5.5 mm diameter product is 60 m/sec. and the rolling is started at 900° C., it is necessary to maintain the thermal conductivity in a range of from 5000 to 10000 Kcal/$m^2$h°C. in order to finish the rolling at 900° C. Thus, it is possible to estimate from the above illustration that the rolling which is started at 800° C. as above can be finished at 850° C. by maintaining the thermal conductivity in a range of from 5000 to 10000 Kcal/$m^2$h °C. by the forced cooling in the rolling mill train.

Then the material is subjected to appropriate in-line heat treatments including cooling on an ordinary cooling trough and controlled cooling under a loosely coiled state so as to obtain a desired quality.

The foregoing description has been made chiefly in connection with the embodiment shown in FIG. 5(A), but the same things can be said in connection with the embodiment shown in FIG. 5(B).

Thus, with a starting material of 210 mm square, an intermediate coiling at 40 mm diameter, and a finishing speed of 90 m/sec. in the secondary rolling step for a final diameter of 5.5 mm, the mass flow velocity in the primary rolling step will be about 4300 $cm^3$/sec., and as shown by 4 in FIG. 2, it is possible to markedly suppress the temperature lowering in the primary rolling step.

The secondary rolling step is divided into two separate blocks, namely the first rolling train and the secondary rolling train. This arrangement has been adopted from the following consideration. The heat generation during the rolling is very large due to the high speed finishing rolling as 90 m/sec., and the final finishing temperature cannot be satisfactorily controlled from the point of the plastic deformation energy only changing the cooling conditions within the mill. Therefore, the cooling by the cooling trough is done between the first and the second blocks so as to suppress the temperature rise during the rolling by the second block within a certain temperature range thereby achieving the desired finishing temperature in the case of the total elongation of 2.5 to 3.0 times, namely with four passes of less.

In short, by the control of the starting temperature of the secondary rolling step, the cooling within the first block of the secondary rolling step, and the cooling by the cooling trough (not shown) between the first and second blocks, the material temperature at the inlet of the second block is set so as to set an appropriate cooling condition within the second block, thereby realizing a desired finishing temperature.

For example, for the rolling of a medium-carbon steel, the material temperature at the inlet of the primary rolling step is about 1000° C. In this case, the material temperature at the outlet of the primary rolling step is also about 1000° C., but the material is cooled after the primary rolling to about 800° C. by the cooling trough and coiled, and then transferred to the heat retaining furnace where it is maintained at about 800° C.

In this case, the secondary rolling is started at about 800° C. at the inlet of the first mill train of the secondary rolling step and the material comes out of the first rolling mill train at about 1000° C. Then the material is cooled to about 850° C. by the cooling trough provided between the first rolling train and the second rolling train of the secondary rolling step.

In the second rolling train of the secondary rolling step, the rolling of the material is started at about 850° C. and finished at about 850° C., and through the second rolling train of a secondary rolling step, the material is forcedly cooled with a thermal conductivity ranging from 10000 to 15000 Kcal/$m^2$h ° C.

According to a further modification of the present invention, by utilizing a special rolling mill which permits a very large reduction rate of cross sectional dimension per one pass as compared with the conventional reduction rate, for example, a high-reduction rolling mill which gives a pushing force causing to the material a compressive stress equivalent to not less than 0.01 but less than 1.0 of the yield stress of the material at a high contact angle, so as to perform the rolling at a high reduction rate, it is possible to simplify the structure of the primary rolling step, and also the relative increase in the rolling speed is very advantageous for the roll life.

Further, a conventional three-roll planetary mill, a swinging forming mill and the like may be used.

In conclusion, the present invention provides a very advantageous process for rolling bars and wire rods applicable to both high carbon and low carbon steel materials.

While the invention has been described in connection with what is presently considered to be the most practical and preferred embodiments, it is to be understood that the invention is not to be limited to the disclosed embodiments but on the contrary, is intended to cover various modifications and equivalent arrangements included within the spirit and scope of the appended claims which scope is to be accorded the broadest interpretation so as to encompass all such modifications and equivalent structures and/or method steps.

Further Explanation Of The FIG. 7 Flow Chart

The following material further explains the meaning of the FIG. 7 flow chart by providing insight to the modeling and mathematical approach presently preferred in arriving at and carrying out the flow chart procedure.

The features of the temperature model assumed in the FIG. 7 procedure are as follows:

(1) The shape of a section of the material is converted into a circular cross-section with an area that is equal to the area of the original shape. Total heat flux at the surface of the material is not changed by the above conversion, so a compensation coefficient is used for this purpose. Then the one-dimensional Fourier's equation of heat conduction is replaced by a finite difference equation.

(2) The temperature change of material caused by thermal energy, which is transformed from the mechanical energy of the plastic deformation and the friction between roll and material and the heat conduction between them, is calculated approximately as a mean value throughout the cross-sectional area.

Temperature Model—Method for calculation:

(1) The calculation of thermal conduction was done by transforming the material to a circle with the same sectional area and differentiating the equation of thermal conduction. The reduction of surface area was corrected by multiplying a correction factor to the film coefficient of heat transfer. Namely, it is assumed that the heat capacity and the heat flow at the surface do not change in transforming the shape of the material.

However, since it is assumed that the circumferential length of the material before transformation is the same as the circumferential length of the hole pattern, a large error takes place in the calculation which the use of the correction factor when the packing degree is small.

(2) The temperature elevation due to working heat and friction heat as well as the temperature lowering due to contact thermal conduction was approximated as the change of means temperature.

(3) The delivery of temperature distribution due to change of sectional area in rolling was calculated by the method of Matsumura, i.e. by proportional allotment.

Each of the factors will be explained in the following:

(1) The equation of thermal conduction is:

$$\frac{\partial T}{\partial t} = a\left(\frac{\partial^2 T}{\partial r^2} + \frac{1}{r}\ \frac{\partial T}{\partial r}\right) \tag{1}$$

where a: thermal diffusivity, r: coordinate in the direction of radius, t: time, T: temperature.

Figure 17:
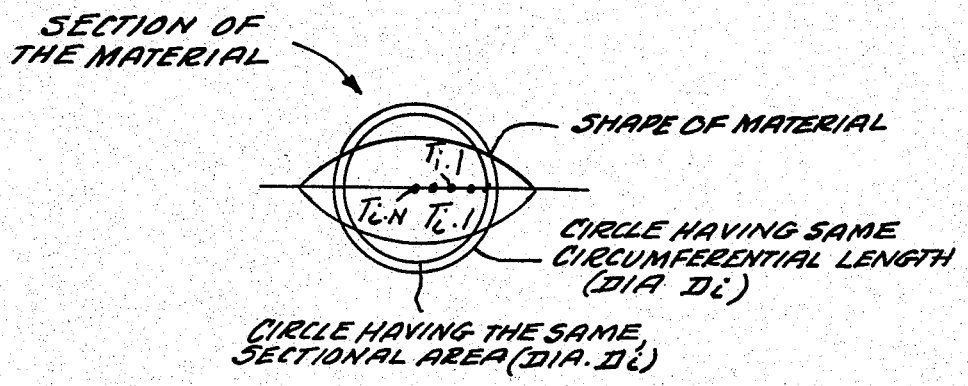
FIG. 17 is a schematic diagram explaining the mathematical model for the FIG. 7 flow chart process and specifically illustrates division in the direction of radius into equal parts.

By differentiating the radius into equal parts as shown in FIG. 17, equation (1) is transformed into equation (2).

To express the position with subscripts 1, i−1, i, i+1, . . . n, and to express the time with subscripts t, t+Δt by taking in every Δt, then $$T_i^{t+\Delta t} = T_i^t + \frac{a\cdot\Delta t}{2(\Delta r)^2}\left\{(T_{i-1}^t - T_i^t)\left(3 - \frac{r_{i+1}}{r_i}\right) + \right. \tag{2}$$

-continued $$\left.(T_{i+1}^t - T_i^t)\left(3 - \frac{r_{i-1}}{r_i}\right)\right\}$$

where $T_i$: temperature at the i-th point (radius $r_i$) and at the time of t+Δt, a: thermal diffusivity, Δt: time interval in calculation $$\left(\frac{a\Delta t}{2\Delta r^2} = \frac{1}{6}\right),$$

Δr: width when the radius is divided into equal parts, $r_i$: radius at the i-th position.

Figure 18:
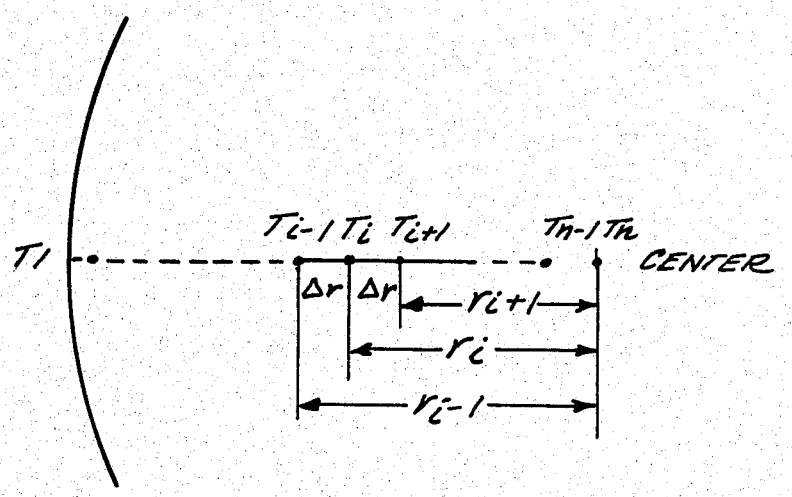
FIG. 18 is a schematic diagram explaining the mathematical model for the FIG. 7 flow chart process and specifically illustrates a method for calculating thermal conduction.
Figure 19:
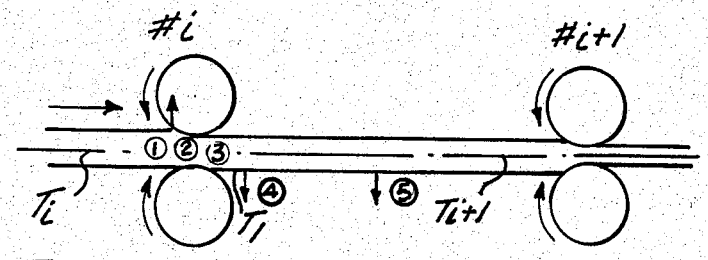
FIG. 19 is a schematic diagram explaining the mathematical model for the FIG. 7 flow chart process and specifically illustrates the change in mean temperature that occurs during rolling.
Figure 20:
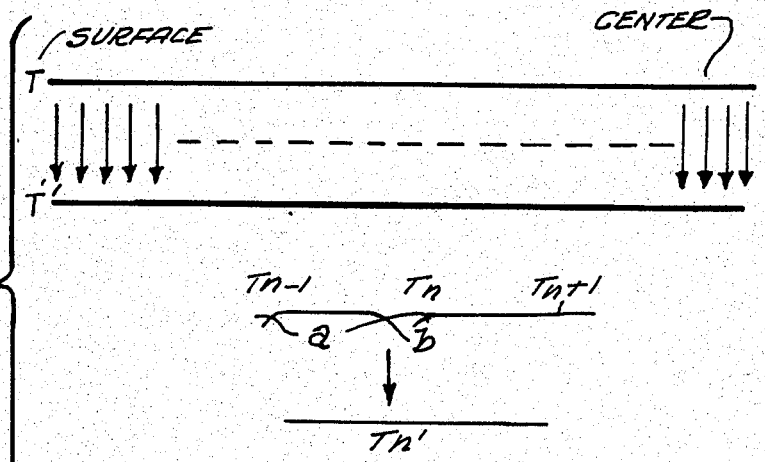
FIG. 20 is a schematic diagram explaining the mathematical model for the FIG. 7 flow chart process and specifically illustrates delivery of temperature between old and new divisions.

The transformation of the material shape and the treatment of the boundary condition are shown in FIGS. 18 and 19. In FIG. 19, ④ represents temperature lowering due to water cooling of the roll and ⑤ represents temperature lowering due to radiation and convection. The change of mean temperature between the new and old divisions at the outlet of the roll bit is shown in FIG. 20.

Boundary condition:

$$\frac{1}{C}\cdot a\cdot(T_{i,1} - T_{\infty}) = \lambda\frac{T_{i,2} - T_{i,1}}{\Delta r} \tag{3}$$

where $C = D_i^1/D_i$: a correction coefficient,

α: film coefficient of heat transfer, $T_\infty$ =: temperature of the fluid at the circumference, λ: thermal conductivity.

(2) Temperature elevation due to working heat and friction heat as well as temperature lowering due to contact thermal conduction:

$$T_i' = T_i + \overline{\Delta T_{Hi}} + \overline{\Delta T_{fi}} + \overline{\Delta T_{ci}} \tag{4}$$

(3) Delivery of the temperature distribution due to the change of the sectional area.

Figure 21A:
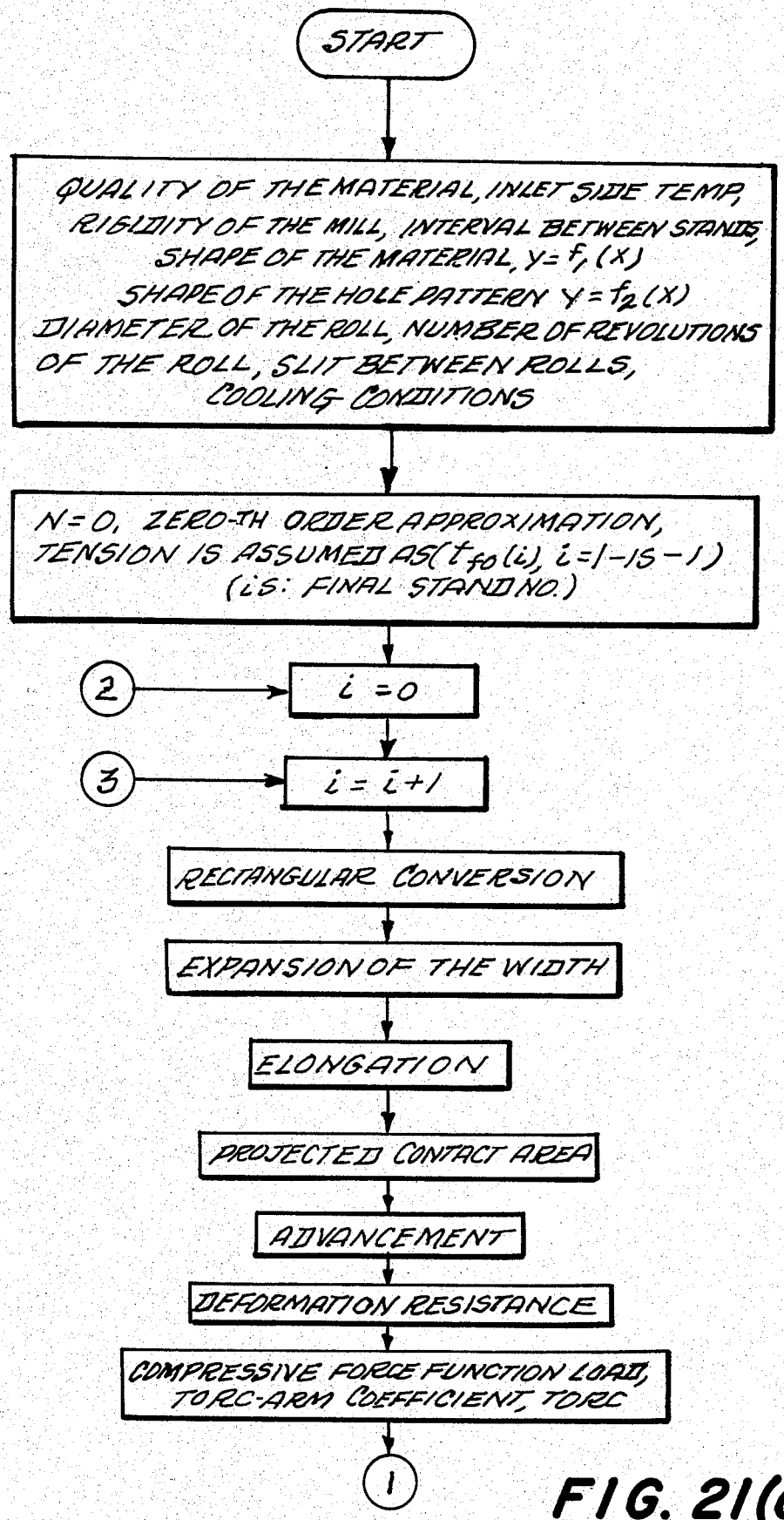
FIGS. 21(*a*)–(*c*) together constitute a flow chart illustrating a procedure for solving a stationary calculation by Newton-Raphson's method which is applicable to the FIG. 7 flow chart procedure.
Figure 21B:
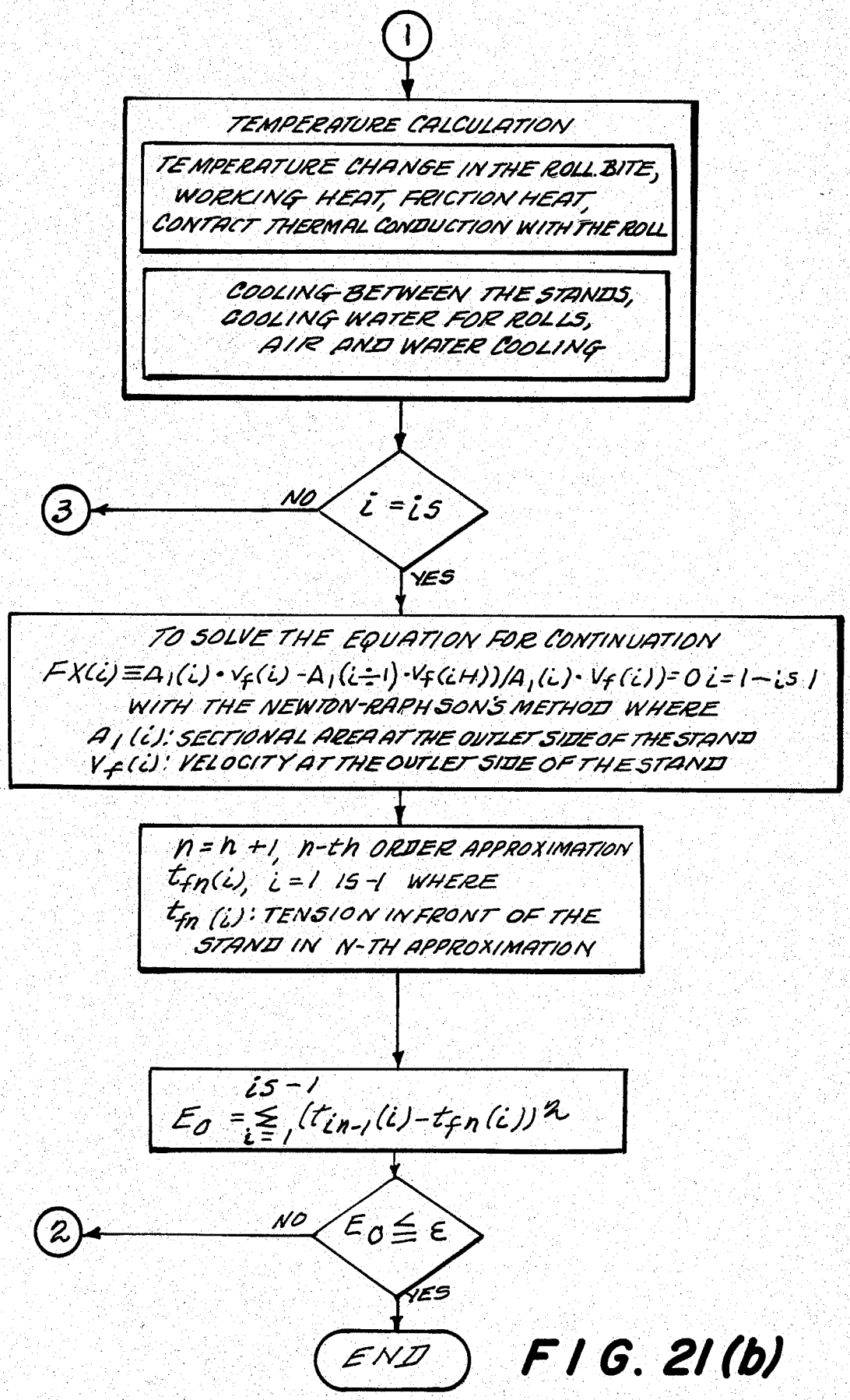
Figure 21:
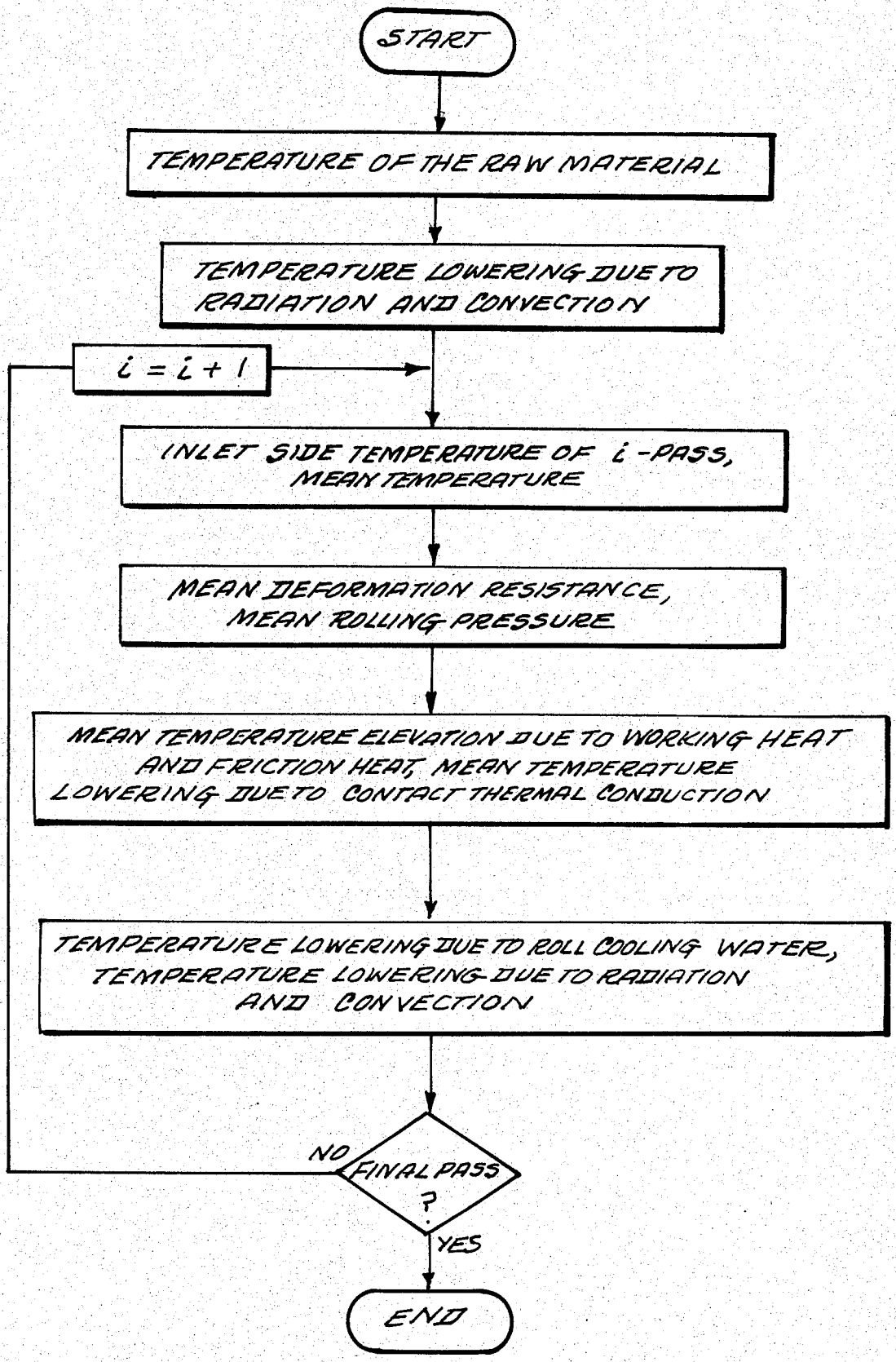

FIGS. 21(*a*)–(*c*) together constitute a flow chart illustrating a procedure for solving a stationary calculation by Newton-Raphson's method which is applicable to the FIG. 7 calculation procedure.

The following further explains the modeling for the heat generation portions of the FIG. 7 flow chart calculations.

(1) Heat generation by working, $\overline{\Delta T_{Hi}}$:

It was assumed that the temperature elevation due to the heat generation by working proceeds uniformly all over the section. In this place, the strain was the value after rectangular conversion.

$$\overline{\Delta T_B} = \frac{A\cdot C1}{C\cdot\gamma}\cdot P_m\cdot l_n\frac{H_{om}}{H_{1m}} \tag{5}$$

where $p_m$: mean rolling pressure,

C: specific heat of the material,

γ: specific gravity of the material, $C_1$: coefficient of correction,

A: heat equivalent of the work.

Note: Assuming that the plastic work energy is transformed completely to heat energy, $C_1 \simeq 0.8$–$1.0$. (In this report, the calculation was done as $C_1 = 1.0$.)

(2) Heat generation by friction, $\overline{\Delta T_{fi}}$:

It was assumed that the temperature elevation due to the friction heat generated between the roll and the material proceeds uniformly all over the section.

$$\overline{\Delta T_{fi}} = \frac{A \cdot f \cdot 2 \cdot \mu \cdot P_m \cdot \overline{v_r} \cdot t_r}{c \cdot \gamma \cdot H_m} \tag{6}$$

$$\overline{v_r} \quad \tfrac{1}{2}(\tfrac{1}{2}(v_f - v_R) + \tfrac{1}{2}(v_R - v_b)) = \tfrac{1}{4}(v_f - v_b) \tag{7}$$

where $\overline{v}_r$: relative speed between the material and the roll, $$t_r = \frac{l_d}{V_R} \text{ : rolling time,} \tag{8}$$

$v_R$: circumferential speed of the roll, $v_f$: speed at the outlet side of the material $v_b$: speed at the inlet side of the material, $\mu$: coefficient of friction between the roll and the material $= 0.3$, $c_f$: the rate of friction heat distributed to the material $= 0.5$.

The following further explains the temperature lowering portions of the FIG. 7 procedure due to the contract thermal conductivity, $\overline{\Delta T_{ci}}$:

The temperature at the stationary state when the roll is contacting with the material (plate) is:

$$T_\infty = \frac{a_S T_{SO} + a_R \cdot T_{RO}}{a_S + a_R} \tag{9}$$

where a: thermal diffusivity,

T: temperature, substricts S: material,

R: roll

O: the state before contact,

L: the state after contact.

Figure 22:
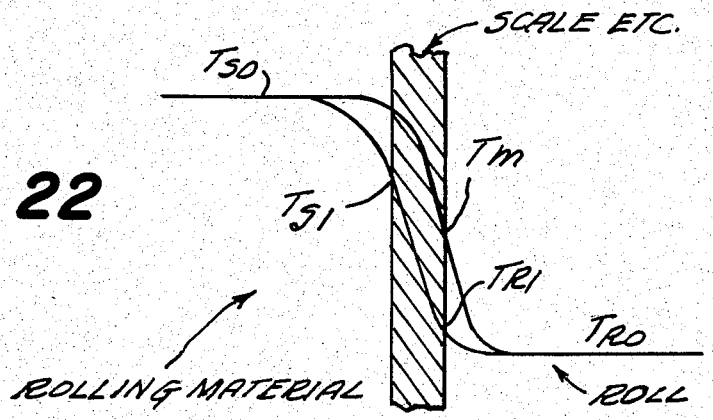
FIG. 22 is a further schematic diagram explaining the FIG. 7 flow chart procedure and specifically illustrates deduction of surface temperature with the use of a correction coefficient $\beta$.

In this place, the treatment of Masuda was adopted. It was assumed that the surface temperature of the material was higher than the value calculated from equation (9) practically, so that the correction coefficients $\beta_R$ and $\beta_S$ were introduced. The state after correction is shown in FIG. 22.

$$\beta_a = 0.85 \tag{10}$$

$$\beta_S = \frac{a_R}{a_S}\left(\frac{T_{RO}}{T_m} - \beta_a + \frac{T_{SO}}{T_m}\right) \tag{11}$$

$$T_{S1} = \beta_S \cdot T_m \tag{12}$$

$$T_{R1} = \beta_R \cdot T_m \tag{13}$$

The heat quantity $q_r$ (kcal/m$^2$h) released by radiation is given by the following equation:

$$q_r = \epsilon \cdot \sigma \cdot (T_s^4 - T_a^4) \tag{14}$$

where $\epsilon$: the rate of radiation $= 0.8$, $\sigma$: *Stefan-Boltzmann's constant* $= 4.88 \times 10^{-8}$ *kcal/m²h°K⁴*, $T_s$: surface temperature of the material, °K., $T_a$: temperature of the circumferential air, °K.

The following further explains the heat transfer terms of the FIG. 7 flow chart procedure.

(1) Air cooling:

1. Natural convection:

Mean film coefficient of heat transfer $\alpha m$ at the outer circumference of a cylindrical tube is:

$$\frac{\alpha_m \cdot d}{\lambda_f} = 0.53\left\{\frac{\beta \cdot g \cdot d^3(T_s - T_a)}{\nu^2}\right\}_f^{\frac{1}{4}}\left(\frac{\nu}{a}\right)^{\frac{1}{4}} \tag{15}$$

range of application:

$$10^4 < \left\{\frac{\beta \cdot g \cdot d^3(T_s - T_a)}{\nu^2}\right\}_f^{\frac{1}{3}} \cdot \left(\frac{\nu}{a}\right)_f^{\frac{1}{3}} \leqq 10^9 \tag{16}$$

$$\frac{\alpha_m \cdot d}{\lambda_f} = 0.13\left\{\frac{\beta \cdot g \cdot d^3(T_2 - T_a)}{\nu^2}\right\}_f^{\frac{1}{3}} \cdot \left(\frac{\nu}{a}\right)_f^{\frac{1}{3}}$$

range of application:

$$10^9 < \left\{\frac{\beta \cdot g \cdot d^3(T_s - T_a)}{\nu^2}\right\}_f \cdot \left(\frac{\nu}{a}\right)_f < 10^{12}$$

where $\alpha m$: mean film coefficient of heat transfer, kcal/m$^2$h °C., $\lambda$: thermal conductivity of the fluid, kcal/m$^2$h °C., $\beta$: cubical expansion coefficient of the fluid, 1/°C., $\gamma$: kinetic viscosity coefficient of the fluid, m$^2$/s, a: thermal diffusivity of the fluid, m$^2$/s, subscript f: means the property value of a matter at a temperature given by $(T_s + T_a)/2$.

2. Forced convection:

(a) Heat transfer at the outer circumference of a cylindrical tube placed parallel to a flow:

Mean film coefficient of heat transfer is $$\frac{\alpha_m \cdot d}{\lambda_f} = C_1\left(\frac{n_o d}{\nu_f}\right)^{n1} C_2 \tag{17}$$

where $C_1$, $n_1$: as shown in Table 2, $C_2$: $\alpha m$ of a cylindrical tube parallel to a flow/$\alpha m$ of a cylindrical tube perpendicular to a flow $\alpha m \simeq 0.5$, d: diameter of a circle having the same circumferential length with that of the section of a material m, $u_o$: material speed, m/s subscript f: means the property of a matter at a temperature given by $(T_s + T_a)/2$.

(b) As a reference, mean file coefficient of heat transfer of a cylindrical body having a section not circular placed perpendicularly to a flow is:

$$\frac{\alpha_m d}{\lambda_f} = c\left(\frac{u_o d}{\lambda_f}\right)^a$$

where n and c are as shown in Table 3.

TABLE 2

| $U_o d/\lambda_f$ | $o_1$ | $c_1$ |
|---|---|---|
| 1~4 | 0.330 | 0.891 |
| 4~40 | 0.385 | 0.821 |
| 40~4000 | 0.466 | 0.615 |
| 4000~40000 | 0.618 | 0.174 |
| 40000~250000 | 0.805 | 0.0239 |

TABLE 3

| Sectional Shape & Flow Direction | $U_o d/\lambda_f$ | a | c |
|---|---|---|---|
| 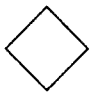 | 2500~7500 | 0.624 | 0.261 |
| | 5000~100000 | 0.588 | 0.222 |
| 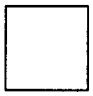 | 2500~800 | 0.699 | 0.150 |
| | 5000~100000 | 0.675 | 0.092 |
| 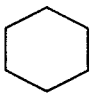 | 5000~19500 | 0.638 | 0.144 |
| | 19500~100000 | 0.782 | 0.035 |
| 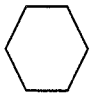 | 5000~100000 | 0.638 | 0.138 |
|  | 4000~15000 | 0.731 | 0.205 |

(2) Cooling water of roll:

Film coefficient of heat transfer α and cooling length l were determined for each of the stands so as to coincide the calculated temperature with the observed temperature.

(a) Block mill for finish:

$\alpha \simeq 1000$ kcal/m²h °C.

l = total length between stands.

(b) Rough, intermediate mill:

$\alpha \simeq 500$ $l \simeq n \times$ roll diameter $n \simeq 1$-3.

ADDITIONAL EXAMPLES

Additional examples to those given earlier in this patent are as follows:

TABLE 4

| | Primary Rolling Condition | |
|---|---|---|
| | Roughing Mill | Intermediate Mill |
| Number of Stand | 8 (No. 1-8 std.) | 8 (No. 9-16 std.) |
| Size of Raw Material | 120 ϕ | 43 ϕ |
| Outlet Side Size | 43 ϕ | 17.1 ϕ |
| Roll Diameter | 480 ϕ | No. 9-12:480 ϕ; No. 13-16:360 ϕ |
| Interval Between Stands | 2600-4100 mm between No. 8 & 9: 12500 mm | 2200-4500 mm between No. 12-13: 25000 mm between No. 16-17: Conventional: 30000 mm Present inventive 30000 mm + Material Storing Device |
| Cooling Condition: Thermal Conductivity of Roll Cooling Water | 3000 kcal/m²h °C. | 1000 kcal/m²h °C. |
| Cooling Length of Roll Cooling Water | 500 mm | 1000 mm |
| Shape of Hole | Square-Diamond | Round-Oval, Oval-Square |
| Quality of Material | S45C (0.45% C Steel) | |
| Temperature of Raw Material | Present Inventive: 900° C. Conventional: 1120° C. | |
| Outlet Side Speed | Present Inventive: 13 m/s at 17.1 ϕ Conventional: 6.5 m/s at 17.2 ϕ | |

TABLE 5

| | Secondary Rolling Condition |
|---|---|
| | Finishing Mill |
| 1. Number of Stands | 10 (No. 17-26 std.) |
| 2. Size of Raw Material | 17.1 ϕ |
| 3. Size of Product | 5.5 ϕ |
| 4. Roll Diameter | No. 17, 18 std: 192 ϕ No. 19-26 std: 145 ϕ |
| 5. Interval Between Stands | between No. 17-18 & 18-19: between No. 19-: 635 mm |
| 6. Cooling Condition | |
| 7. Thermal Conductivity of Roll Cooling Water | 1000 kcal/m² °C. |
| 8. Cooling Length of Roll Cooling Water | Total Length of the Stands |
| 9. Shape of Hole | Round-Oval |
| 10. Quality of Material | S45C (0.45% C Steel) |
| 11. Inlet Side Temperature | Present Inventive: 700° C. Conventional: 950° C. |
| 12. Outlet Side Speed | Present Inventive: 30 m/s at 5.5 ϕ Conventional: 60 m/s at 5.5 ϕ |

TABLE 6

| | Primary Rolling | | | | | | Secondary Rolling | | | |
|---|---|---|---|---|---|---|---|---|---|---|
| | Raw Material | | Intermediate Gauge | | | | Inlet Side | | Final Gauge | |
| | Quality, Size | Heating Temp. | Size | Speed | Mean Temp. | Coiling/Uncoiling | Mean Temp. | Size | Speed | Mean Temp. |
| Present Invention | S45C (0.45% C Steel) 120 ϕ | 900° C. | 17.1 ϕ | 13 m/s mass flow 3030 cm³/sec. | 1020° C. | Coiling: 1 strand Uncoiling: 4 strands 700° C. Heating | 700° C. | 5.5 ϕ | 30 m/s mass flow 7,57 cm³/sec. | 875° C. |
| Conventional | 120 ϕ | 1120° C. | 17.1 ϕ | 6.5 m/s mass flow | 975° C. | | 950° C. | 5.5 ϕ | 60 m/s mass flow | 1058° C. |

TABLE 6-continued

| Primary Rolling | | | | | | Secondary Rolling | | | |
|---|---|---|---|---|---|---|---|---|---|
| Raw Material | | Intermediate Gauge | | | | Inlet Side | | Final Gauge | |
| Quality, Size | Heating Temp. | Size | Speed | Mean Temp. | Coiling/Uncoiling | Mean Temp. | Size | Speed | Mean Temp. |
| | | 1,515 $cm^3$/sec. | | | | | 1,515 $cm^3$/sec. | | |

Temperature Control In Finishing Block Mill

Figure 23:
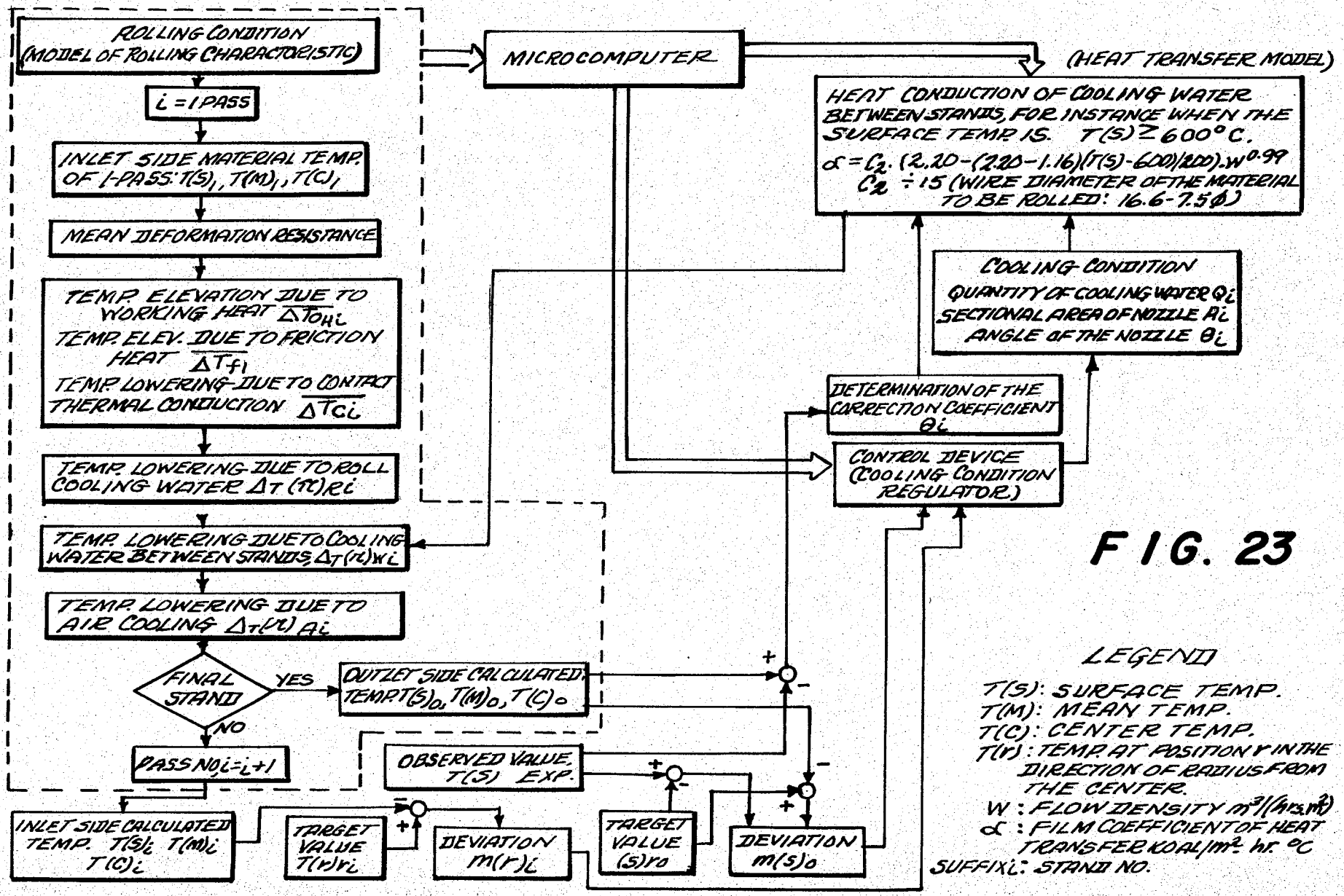
FIG. 23 is a flow chart illustrating temperature control in the finishing block mill.

FIG. 23 shows the temperature control in the finishing block-mill. In the model of rolling characteristics, the inlet side surface temperature $T(S)_1$, the mean temperature $T(M)_1$ and the center temperature $T(C)_1$ of the material at the No. i=1 pass of the stand are given in the first place. Thereby, $T(S)_1$ is determined experimentally and $T(M)_1$ and $T(C)_1$ are calculated from the working and cooling histories. Then, the mean deformation resistance, the mean temperature elevation due to the working heat, $\overline{\Delta T_{Hi}}$, the mean temperature elevation due to the friction heat, $\overline{\Delta T_{fi}}$, and the mean temperature lowering due to the contact thermal conduction, $\overline{\Delta T_{ci}}$, are calculated respectively. Further, the cooling process is calculated due to the heat conduction model. The temperature lowering due to the roll cooling water, $\Delta T(r)_{Wi}$ determined in such a way that the observed value coincides with the calculated value by assuming that the cooling length equals to the interval between the stands and the film coefficient of heat transfer is 1000 kcal/$m^2$. hr.°C. in calculation. In this instance, $\Delta T(r)_{Wi}$ is calculated in accordance with the infinitesimal time corresponding to the infinitesimal length obtained by dividing the material in equal parts in the radius direction so that the differential calculation converges sufficiently, i.e., one by one infinitesimal length from the upper stream to the lower stream along the rolling direction. The temperature lowering due to the cooling water between stands, $\Delta T(r)_{Wi}$, is calculated similarly as in the case of roll cooling water from the cooling condition, which is obtained by the experiment and the stimulation calculation, and the experimental formula of the film coefficient of heat transfer, $N_u = c \cdot R_e^n$. The temperature lowering due to air cooling, i.e., due to radiation and convection, $\Delta T(R)_{Ai}$, is calculated similarly by the well known experimental formula of heat transfer. However, in the finishing block-mill, water cooling is done all over the total length of the stands, so that the temperature lowering due to air cooling is not done at all. Thus, the calculation of i=1 pass can be completed.

The calculation for the lower stream stands on and after 2 pass can be done similarly by putting i=i+1. At the outlet side of the stands cooled with water, i.e., stands i=5, 6, 7 and 8 in this example, the present control is done for controlling the flow quantity based on the deviation $m(r)_i$ by comparing the calculated inlet side temperatures $T(S)_i$, $T(M)_i$, i=6, 7, 8 and 9 with the target value $T(r)_{ri}$. Further, the outlet side calculated temperature of the last stand, $T(S)_o$, is compared with the observed value $T(S)_{exp}$, and the correction coefficient c of the film coefficient of heat transfer of the cooling water between the stands is determined on the basis of the deviation thereof for carrying out the suitability control.

From the above, the cooling condition with the use of cooling water between the stands, i.e., the flow quantity in the case when the angle of nozzle $\theta_i$ and the sectional area of the nozzle outlet $A_i$ are given, can be determined by the preset control. Further, in the case when the material temperature at the inlet side of the finishing block-mill is disturbed externally, it is necessary to control the outlet side temperature constant from the top to the end of the material. Therefore, the observed value of the outlet side temperature determined continuously, $T(S)_{exp}$, is compared with the target value $T(S)_{ro}$, and the feedback control is done for controlling the flow quantity $Q_i$ by means of a flow quantity regulator based on the deviation $m(S)_o$.

What is claimed is:

1. A process for rolling bars or wire rods from billets or blooms comprising the steps of:
   (a) heating the billets or blooms to a temperature of about 900° C.;
   (b) subjecting the thus heated billets or blooms to a primary rolling step at about 865° C.±15° C. with a first mass flow velocity of about 5700 $cm^3$/sec.;
   (c) coiling the rolled material thus obtained in the form of a coil while controlling the temperature of the coiled material to about 800° C. on an uncoiler in a storing furnace;
   (d) uncoiling and subjecting the material to a secondary rolling step at a second mass flow velocity; then
   (e) heat treating in line and coiling the rolled material after the second rolling step, providing that the above listed steps are conducted under conditions wherein: (1) the first mass flow velocity of the billets or blooms in the primary rolling step (b) and the second mass flow velocity of the material in the secondary rolling rate of step (d) are independent of each other, and (2) the temperature of the material of step (c) is controlled such that the material delivered from step (e) has a predetermined temperature.

2. A process according to claim 1 wherein step (c) comprises the step of controlling temperature in accordance with the formulae of FIG. 7.

3. A process for rolling bars or wire rods from billets or blooms comprising the sequential steps of:
   (a) heating the billets or blooms to a temperature of about 900° C.;
   (b) subjecting the thus heated billets or blooms to a primary rolling step at about 865° C.±15° C. at a first mass flow velocity of about 5700 $cm^3$/sec.;
   (c) accumulating the rolled material thus obtained and controlling the temperature of the accumulated material to about 800° C. in a storing furnace; and
   (d) uncoiling and subjecting the material of step (c) to a secondary rolling step at a second mass flow velocity, then
   (e) heat treating in line and coiling the rolled material after the secondary rolling step providing that the above listed steps are conducted under conditions wherein: (1) the first mass flow velocity of the billets or blooms in the primary rolling step (b) and the second mass flow velocity of the material in the secondary rolling rate of step (d) are independent of each other, and (2) the temperature of the material of step (c) is controlled such that the material delivered from step (e) has a predetermined temperature.

4. A process according to claim 3 wherein step (c) comprises the step of controlling temperature in accordance with the formulae of FIG. 7.

5. A process for rolling bars and wire rods of a desired cross-sectional dimension and quality from billets or blooms of large square or round cross-section, said process comprising the successive steps of:

(a) rolling the billet or bloom in a primary rolling step at a first rolling speed and selecting a mass flow velocity to minimize the total energy consumed in the primary rolling while maintaining the material at about its plastic deformation temperature to produce an intermediate gauge material;

(b) storing the intermediate gauge material and controlling the temperature of the intermediate gauge material between the preceding step and the succeeding step;

(c) rolling the intermediate gauge material in a secondary rolling step at a second mass flow velocity and at a rate such that the temperature of the material increases during the second rolling thereby producing a material of the final gauge; and (d) heat treating the material from the secondary rolling step in line;

providing that the above listed steps are conducted under conditions wherein (1) the mass flow velocity of the billet or bloom in the primary rolling is independent of the mass flow velocity of the material in the secondary rolling, (2) the temperature of the material at the starting point of the primary rolling step is independent of the temperature of the intermediate material at the start of the secondary rolling step, and (3) the temperature of the intermediate product is controlled in accordance with the formulae of FIG. 7 such that the temperature at the start of the secondary rolling step is established to deliver a product at the end of the secondary rolling step in accordance with the rolling conditions in the secondary rolling step and in-line heat treatment step that falls within a predetermined range.

6. A process according to claim 5 further comprising between steps (a) and (b) the step of cooling the intermediate gauge material.

7. A process according to claim 5 wherein rolling step (c) comprises the steps of rolling to produce a gauge of the final product delivered from step (d) that is about one-tenth the gauge of the intermediate material.

8. A process according to claim 5 wherein the step (b) comprises the step of controlling the temperature of the intermediate gauge material to a starting temperature of the secondary rolling step in a range from 600° to 900° C.

9. A process according to claim 5 wherein step (b) comprises the step of coiling the intermediate gauge material.

10. A process according to claim 5 wherein step (b) comprises the step of accumulating the intermediate gauge material.

* * * * *